US009235194B2

(12) United States Patent
Higgins

(10) Patent No.: US 9,235,194 B2
(45) Date of Patent: Jan. 12, 2016

(54) ELAPSED TIME INDICATOR

(75) Inventor: Peter Higgins, Edinburgh (GB)

(73) Assignee: UWI TECHNOLOGY LTD (GB)

( * ) Notice: Subject to any disclaimer, the term of this patent is extended or adjusted under 35 U.S.C. 154(b) by 631 days.

(21) Appl. No.: 13/574,629

(22) PCT Filed: Jan. 26, 2011

(86) PCT No.: PCT/GB2011/000097

§ 371 (c)(1),
(2), (4) Date: Aug. 8, 2012

(87) PCT Pub. No.: WO2011/092461

PCT Pub. Date: Aug. 4, 2011

(65) Prior Publication Data

US 2012/0291894 A1 Nov. 22, 2012

(30) Foreign Application Priority Data

Jan. 26, 2010 (GB) ..... 1001235.9

(51) Int. Cl.
*G04F 1/00* (2006.01)
*G04F 13/06* (2006.01)
*B65D 55/02* (2006.01)

(52) U.S. Cl.
CPC ..... *G04F 1/00* (2013.01); *B65D 55/026* (2013.01); *G04F 13/06* (2013.01); *Y10T 29/49826* (2013.01); *Y10T 137/8208* (2013.01)

(58) Field of Classification Search
CPC ..... G04F 1/00; G04F 13/04; G04F 13/06; B65D 55/026; Y10T 29/49826; Y10T 137/8208
USPC ..... 368/327
See application file for complete search history.

(56) References Cited

U.S. PATENT DOCUMENTS 3,414,415 A * 12/1968 Broad, Jr. ..... 116/219
3,479,877 A * 11/1969 Allen et al. ..... 374/106
4,382,700 A * 5/1983 Youngren ..... 374/102
4,408,557 A * 10/1983 Bradley et al. ..... 116/206
5,930,023 A * 7/1999 Mitchell et al. ..... 359/270

(Continued)

FOREIGN PATENT DOCUMENTS

CN 1533518 9/2004
CN 101103268 A 1/2008

(Continued)

OTHER PUBLICATIONS

Chinese Office Action for corresponding application 201180014329.8; Issued Nov. 29, 2013.

(Continued)

*Primary Examiner* — Vit W Miska
(74) *Attorney, Agent, or Firm* — Cantor Colburn LLP

(57) ABSTRACT

An elapsed time indicator (2), comprises an activator arrangement (25) comprising a fluid reservoir (20) and a conduit (22) configured to provide a predetermined flow rate of fluid (21) along the conduit (22). The elapsed time indicator (2) further comprises a visual display arrangement (18) configured to change appearance on exposure to the fluid (21). The conduit (22) connects the fluid reservoir (20) to the visual display arrangement (18). The activator arrangement (25) is configured to release fluid (21) from the fluid reservoir (20) in response to an activation event to permit the fluid (21) to flow.

30 Claims, 18 Drawing Sheets

(56) References Cited

U.S. PATENT DOCUMENTS

| | | | | |
|---|---|---|---|---|
| 6,243,192 | B1 * | 6/2001 | Mitchell et al. | 359/270 |
| 6,373,786 | B1 | 4/2002 | Kagan et al. | |
| 6,616,893 | B1 * | 9/2003 | Pham | 422/417 |
| 6,664,887 | B1 | 12/2003 | Fuchs | |
| 6,973,894 | B1 * | 12/2005 | Adamy et al. | 116/206 |
| 7,280,441 | B2 * | 10/2007 | MacDonald et al. | 368/327 |
| 7,372,780 | B1 | 5/2008 | Braunberger | |
| 7,429,126 | B2 * | 9/2008 | Maschietti et al. | 374/102 |
| 7,808,861 | B2 * | 10/2010 | Wien | 368/327 |
| 2008/0295761 | A1 | 12/2008 | Ambrozy et al. | |

FOREIGN PATENT DOCUMENTS

| | | | |
|---|---|---|---|
| FR | 1185197 | | 7/1959 |
| FR | 1527249 | | 6/1969 |
| GB | 2243825 | A | 11/1991 |
| GB | 2344101 | A | 5/2000 |
| GB | 2368908 | A | 5/2002 |
| GB | 2419868 | A | 5/2006 |
| WO | 0126993 | A1 | 4/2001 |
| WO | 2009040547 | A2 | 4/2009 |

OTHER PUBLICATIONS

International Search Report; International Application No. PCT/GB2011/000097; International Filing Date Jan. 26, 2011; Mail Date Jul. 19, 2011.

Written Opinion; International Application No. PCT/GB2011/000097; International Filing Date Jan. 26, 2011; Mail Date Jul. 19, 2011.

* cited by examiner (b)

(a)

ELAPSED TIME INDICATOR

FIELD OF THE INVENTION

The present invention relates to an elapsed time indicator that is configured to provide an indication of time elapsed from a first relative movement between two objects.

BACKGROUND OF THE INVENTION

Many products, particularly in the food and pharmaceutical industries, degrade, decay or perish over a finite lifetime. The rate at which such products degrade may depend on the environmental conditions. Accordingly, such products are often inserted into a container under controlled environmental conditions and the container is sealed so as to isolate the products from an environment external to the container and thereby keep the products fresher for longer. On opening such a container for the first time, the products contained within are exposed to the external environment and degradation of the products typically accelerates relative to a rate of degradation of the products when in the sealed container. Accordingly, it is conventional to specify both a shelf life for products contained in a sealed container prior to opening the container and a period within which the products should be used after first opening the container.

A problem with storing products in containers in this way is that, without recording the time of first opening a specific container, it is difficult to determine to what extent the products contained within the container have degraded and, in particular, whether the period within which the products should have been used after first opening the container has expired. In the case of food or pharmaceutical products, consumption of such products after expiry of the period within which the products should have been used after first opening the container may represent a health risk. Various solutions to this problem exist. However, the known solutions may be expensive to manufacture, inaccurate or unreliable.

For some applications, particularly in the oil and gas industries, it is also known that a device may have a finite lifetime or a predetermined service interval. The device may, for example, be configured for insertion downhole or for use in a subsea environment or the like. The device may comprise an assembly, a tool, a tubing string or the like. However, known methods of monitoring the time elapsed from activation of such a device may be expensive, inaccurate or unreliable.

SUMMARY OF THE INVENTION

According to a first aspect of the present invention there is provided an elapsed time indicator for a container, comprising:

a visual display arrangement configured to provide a visual indication of the time elapsed from opening an associated container for the first time; and an activator arrangement configured to activate the visual display arrangement upon opening of an associated container for the first time.

The elapsed time indicator may be configured to provide an indication of the time remaining until expiry of a lifetime of the contents of an associated container after opening the container for the first time. For example, the visual display arrangement may be configured to provide an indication of the time remaining until expiry of a lifetime of the contents of an associated container after opening the container for the first time.

The elapsed time indicator may be configured to provide an indication of a number of units of time that have elapsed since opening the container for the first time. For example, the elapsed time indicator may be configured to provide an indication of a number of minutes, hours, days, weeks, months, years or the like that have elapsed since opening the container for the first time.

The elapsed time indicator may be configured for use with containers containing various goods, such as foodstuffs, medicaments, cosmetics, chemicals, paints, sealants or the like.

The elapsed time indicator may be configured to provide an indication of bacteria levels or levels of other organisms in food. The container may, for example, contain food and the indication of the time elapsed since opening the container for the first time provided may, in particular, provide an indication of bacteria levels or levels of other organisms in the food.

The container may be a jar, carton, bottle, tube, packet, package or the like.

The container may be formed from at least one of glass, card, plastic, metal or the like.

The elapsed time indicator may be configured to be torn, severed, ruptured and/or sheared on opening the container for the first time. For example, the activator arrangement may be configured to be torn, severed, ruptured and/or sheared on opening the container for the first time.

The elapsed time indicator may comprise a paper, polymer or plastics substrate or a substrate formed from any other suitable material. For example, the elapsed time indicator may comprise a polymethyl methacrylate (PMMA) substrate.

The activator arrangement may be configured for attachment to both a lid and a body of the container. For example, the activator arrangement may comprise a lid portion configured for attachment to the lid of the container and a body portion configured for attachment to the body of the container.

The activator arrangement may comprise a tensile member which is configured for attachment between a lid and a body of the container and which remains with the lid or the body on opening of the container to thereby exert a tensile force between the lid and body portions of the elapsed time indicator as the lid is moved away from the body.

The activator arrangement may be configured to be torn, severed, ruptured and/or sheared when the lid is removed from the body of the container for the first time in order to open the container for the first time.

The visual display arrangement may be configured to undergo a change in appearance according to the time elapsed since opening a container for the first time.

The visual display arrangement may be configured to undergo a change in one or more optical properties according to the time elapsed since opening a container for the first time.

The visual display arrangement may be configured to change colour according to the time elapsed since opening a container for the first time.

The visual display arrangement may be configured to undergo a change in optical transmission, absorption and/or reflection according to the time elapsed since opening a container for the first time.

The visual display arrangement may have a coloured background and the visual display arrangement may be configured to undergo a change in optical transmission, absorption and/or reflection so as to reveal or obscure the coloured background.

The visual display arrangement may be configured to provide an indication of a number of units of time that have elapsed since opening the container for the first time.

For example, the visual display arrangement may be configured to provide an indication of a number of minutes, hours, days, weeks, months, years or the like that have elapsed since opening the container for the first time.

The visual display arrangement may comprise a plurality of regions for indicating the time elapsed since opening a container for the first time.

The visual display arrangement may comprise a plurality of regions wherein each region is configured to undergo a change in appearance after a different corresponding period of time has elapsed since opening the container for the first time.

The visual display arrangement may comprise indicia in the form of text, a numeral, and/or a symbol.

The visual display arrangement may comprise a plurality of regions wherein each region is configured to undergo the same change in appearance according to the time elapsed since opening a container for the first time.

The visual display arrangement may comprise a plurality of regions wherein each of the regions is configured to undergo the same change of colour according to the time elapsed since opening a container for the first time.

The visual display arrangement may comprise a plurality of regions wherein each region is configured to undergo a different change in appearance relative to a change in appearance of the other regions according to the time elapsed since opening a container for the first time.

The visual display arrangement may comprise a plurality of regions wherein at least one of the regions is configured to undergo a different change of colour to the other regions according to the time elapsed since opening a container for the first time.

The elapsed time indicator may be configured to provide a stimulus to the visual display arrangement on opening a container for the first time to initiate a reaction in the visual display arrangement. For example, the activator arrangement may be configured to provide a stimulus to the visual display arrangement on opening a container for the first time to initiate a reaction in the visual display arrangement. The reaction may, for example, proceed over a timescale matched to the lifetime of the contents of the container after opening the container for the first time.

The elapsed time indicator may be configured to provide a reactant to support a reaction in the visual display arrangement. For example, the elapsed time indicator may be configured to provide a reactant to support a reaction in the visual display arrangement over a timescale matched to the lifetime of the contents of the container after opening for the first time. For example, the activator arrangement may be configured to provide a reactant to support a reaction in the visual display arrangement over a timescale matched to the lifetime of the contents of the container after opening for the first time.

The visual display arrangement may be configured to indicate the time elapsed since opening the container for the first time according to at least one of a chemical, biological, biochemical, electrical, electrochemical, electrochromic, chemochromic and halochromic reaction or any other kind of reaction.

The elapsed time indicator may comprise a substance or fluid capable of changing appearance according to a pH level of a fluid.

The elapsed time indicator may comprise a pH indicator dye.

The elapsed time indicator may comprise a colour former. For example, the elapsed time indicator may comprise crystal violet lactone (CVL).

The elapsed time indicator may comprise a colour former based on one or more fluorans. Such a colour former may be advantageous because it can be converted from a colourless appearance to a coloured appearance by a weak acid.

The elapsed time indicator may comprise pergascript green.

The elapsed time indicator may comprise pergascript red.

The elapsed time indicator may comprise an anthocyanin. Many anthocyanins are naturally occurring and may be toxicologically acceptable.

The elapsed time indicator may comprise a pH indicator. For example, the elapsed time indicator may comprise at least one of gentian violet (methyl violet), leucomalachite green (first transition), leucomalachite green (second transition), thymol blue (first transition), thymol blue (second transition), methyl yellow, bromophenol blue, congo red, methyl orange, bromocresol green, methyl red, methyl red/bromocresol green, azolitmin, bromocresol purple, bromothymol blue, phenol red, neutral red, naphtholphthalein, cresol red, phenolphthalein, thymolphthalein, alizarine yellow R, and litmus and the like.

The visual display arrangement may, in particular, comprise a pH indicator comprising one or more regions comprising naphtholphthalein and a region comprising phenolphthalein. This may be advantageous because naphtholphthalein changes from a colourless appearance to a pale red or a greenish-blue colour at high pH, while phenolphthalein changes from a colourless appearance to a red colour at high pH.

The elapsed time indicator may comprise a metal, for example, metal ions such as metal cations. This may be advantageous because metal cations may produce coloured compounds through reaction with an anion to form a coloured salt or through reaction with a ligand to form a coloured metal complex ion.

The elapsed time indicator may comprise a transition metal.

The elapsed time indicator may comprise iron. For example, the elapsed time indicator may comprise an iron compound.

The elapsed time indicator may comprise a fluid reservoir. For example, the activator arrangement may comprise a fluid reservoir.

The fluid reservoir may contain a fluid.

The fluid reservoir may isolate a fluid from an environment external to the elapsed time indicator.

The fluid reservoir may be airtight.

The fluid may, for example, be suitable for initiating a reaction in the visual display arrangement or may be a reactant that supports a reaction in the visual display arrangement. For example, the visual display arrangement may comprise a further reactant that reacts on contact with the fluid.

The fluid may, for example, be a solution or a suspension.

The fluid may comprise particles such as micro-particles or nano-particles or the like.

The fluid may comprise a gas.

The fluid may be electrically charged or comprise charged particles such as ions, molecules or the like.

The fluid may comprise an acid, acid molecules, hydrogen ions or the like.

The fluid may comprise a naturally occurring acid such as acetic or citric acid or the like. Such acids may be safe for human or animal consumption and may not be prohibited for use under food packaging or food safety regulations.

The fluid may be magnetic or comprise magnetic particles or the like.

The fluid may comprise a substance, chemical or the like.

The fluid may comprise bacteria, micro-organisms or a biological agent or the like.

The fluid may be coloured. For example, the fluid may comprise a dye or the like.

The fluid may be colourless. For example, the fluid may be colourless, but may stimulate a change in appearance of the visual display arrangement on exposure of the visual display arrangement to the fluid.

The fluid may comprise an acid and the visual display arrangement may comprise a pH indicator dye or a colour former.

The fluid may comprise a pH indicator dye or a colour former and the visual display arrangement may comprise an acid.

The elapsed time indicator may comprise a frangible element such as a frangible barrier, membrane or the like. For example, the activator arrangement may comprise a frangible element such as a frangible barrier, membrane or the like.

The frangible element may be configured to release fluid from the fluid reservoir on opening the container for the first time. For example, the frangible element may be broken or severed on opening the container for the first time.

The elapsed time indicator may comprise an activator element and a complementary recess, wherein the activator element is receivable within the recess so as to prevent movement of fluid from the fluid reservoir towards the visual display arrangement and is movable within the recess so as to draw fluid from the fluid reservoir towards the conduit.

The activator element may be attached to a tensile member which is configured for attachment between a lid and a body of the container and which remains with the lid or the body on opening the container to thereby exert a tensile force on the activator element and move the activator element within the recess on opening the container for the first time so as to draw fluid from the fluid reservoir towards the conduit on opening the container for the first time.

The activator arrangement may comprise a resilient membrane. For example, the activator arrangement may comprise a silicone membrane. The activator arrangement may be configured such that the membrane is elastically deformed when the activator element is inserted into the recess to form a seal between the membrane and a substrate of the elapsed time indicator to thereby seal the fluid in the fluid reservoir.

The activator arrangement may be configured such that movement of the activator element within the recess causes the membrane to disengage from a surface of the substrate to draw fluid from the fluid reservoir towards the conduit.

The activator arrangement may comprise a flow stop element which is held in engagement with the membrane by the activator element so as to elastically deform the membrane to form a seal between the membrane and the substrate to thereby seal the fluid in the fluid reservoir.

The activator arrangement may be configured so that movement of the activator element within the recess allows the flow stop element to move in response to a restoring force arising in the elastically deformed membrane by virtue of the resilience of the membrane thereby permitting the membrane to disengage from the substrate and drawing fluid from the fluid reservoir towards the conduit.

The elapsed time indicator may comprise a conduit connecting the fluid reservoir to the visual display arrangement. The elapsed time indicator may be configured so that the released fluid moves from the fluid reservoir through the conduit to the visual display arrangement.

The elapsed time indicator may comprise a conduit connecting the fluid reservoir to the visual display arrangement, wherein the conduit is configured to control a flow rate of the fluid to the visual display arrangement. The conduit may be configured to control a flow rate of the fluid to the visual display arrangement according to the contents of a container associated with the elapsed time indicator.

The size and/or shape of the conduit may be chosen to control a flow rate of the fluid to the visual display arrangement. In particular, the length and/or cross-section of the conduit may be chosen to control a flow rate of the fluid to the visual display arrangement.

In at least one embodiment, the conduit may have a variable cross-section along a length of the conduit. For example, the conduit may comprise a plurality of first portions each having a greater cross-section and a plurality of second portions each having a lesser cross-section, wherein adjacent first portions are connected by a respective second portion. Such a conduit may retard the flow of fluid along the conduit between the fluid reservoir and the visual display arrangement, thus enabling the production of an elapsed time indicator capable of indicating elapsed time periods of greater duration. Such a conduit may, in particular, retard the flow of fluid along the conduit to such an extent so as to enable the production of an elapsed time indicator capable of indicating elapsed time periods of several days or weeks.

The conduit may, for example, have a uniform thickness and may comprise a plurality of wider portions and a plurality of narrower portions, wherein adjacent wider portions are connected by a respective narrower portion. The narrower portions may be linear and/or curved.

The material from which the conduit is formed may be chosen to control a flow rate of the fluid to the visual display arrangement.

The fluid may be chosen to control a flow rate of the fluid to the visual display arrangement. For example, a more viscous fluid may be chosen to reduce the flow rate of the fluid to the visual display arrangement or a less viscous fluid may be chosen to increase the flow rate of the fluid to the visual display arrangement.

The conduit may comprise a capillary and the released fluid may be drawn through the conduit under capillary action.

The conduit may comprise a microfluidic channel.

The conduit may comprise a porous material such as a porous paper or a porous polymer or the like. For example, the conduit may comprise filter paper.

The conduit may comprise a porous strip.

The conduit may comprise one or more microfibres.

The conduit may have a thickness of between 100 nm and 100 mm, of between 1 μm and 10 mm, or between 10 μm and 1 mm. The conduit may have a thickness substantially equal to 100 μm. Such conduit thicknesses may ensure that a fluid moves along the conduit by capillary action.

The conduit may comprise a porous strip having a uniform thickness, a plurality of wider pad portions and a plurality of narrower channel portions, wherein adjacent pad portions are connected by a respective channel portion. The narrower portions may be linear and/or curved.

In at least one embodiment, the conduit may comprise a porous strip sealed between polymer layers. For example, the conduit may comprise a porous strip sealed between polymethyl methacrylate (PMMA) layers.

The conduit may be isolated or sealed from an environment external to the conduit. For example, the conduit may be airtight.

When the conduit and the fluid reservoir are both airtight, the activator arrangement may be configured so that movement of an activator element within a recess formed within a substrate of the elapsed time indicator causes a reduction in local pressure between the fluid reservoir and the conduit thereby drawing fluid from the fluid reservoir into, towards or into communication with the conduit.

The elapsed time indicator may comprise a network of conduits connecting the fluid reservoir to a visual display arrangement comprising a plurality of regions.

The elapsed time indicator may comprise a visual display arrangement wherein the visual display arrangement is maintained at a pressure less than atmospheric pressure when the container is unopened.

The elapsed time indicator may comprise a frangible element that is configured to release a fluid into a conduit connecting the fluid reservoir to a reduced pressure visual display arrangement on opening the container for the first time. For example, the activator arrangement may comprise a frangible element that is configured to release a fluid into a conduit connecting the fluid reservoir to a reduced pressure visual display arrangement on opening the container for the first time. Such an arrangement results in the released fluid moving towards the visual display arrangement under the action of a pressure differential on opening the container for the first time to either initiate or supply a reaction in the visual display arrangement.

The elapsed time indicator may comprise a device for attracting a fluid. For example, the activator arrangement may comprise a device for attracting the fluid towards the visual display arrangement.

For example, the elapsed time indicator may comprise a magnet and the fluid may be magnetic. For example, the fluid may comprise a magnetic material, a magnetic liquid, magnetic particles or the like.

The elapsed time indicator may comprise a battery and the fluid may be electrically charged. For example, the activator arrangement may comprise a battery and the fluid may be electrically charged. The fluid may comprise electrically charged particles, ions, molecules or the like.

The elapsed time indicator may comprise a conduit connecting the device for attracting a fluid to the fluid reservoir.

The elapsed time indicator may comprise a network of conduits connecting the device for attracting a fluid and a visual display arrangement to the fluid reservoir. For example, the network of conduits may comprise a conduit connecting the device for attracting a fluid to the fluid reservoir and a further conduit connecting the conduit to the visual display arrangement. The network of conduits may comprise a conduit connecting the device for attracting a fluid to the fluid reservoir and a plurality of further conduits, each further conduit connecting the conduit to a respective region of the visual display arrangement.

The elapsed time indicator may comprise bacteria and a visual display arrangement configured to change appearance in response to the presence of the bacteria at the visual display arrangement.

The bacteria may be staphylococcus, or a coliform such as *escherichia coli* (*E. coli*).

The visual display arrangement may be configured to change colour in response to the presence of the bacteria at the visual display arrangement. The visual display arrangement may comprise a growth medium for the bacteria.

The visual display arrangement may comprise a chemical, biological, biochemical, chemochromic or halochromic reagent or any other kind of reagent.

The visual display arrangement may comprise a source of amino acids chosen from the group consisting of meat peptones, vegetable peptones, casein hydrolysates, tryptose, tryptones and yeast extract.

The visual display arrangement may comprise a source of glucides chosen from monometric or oligomeric glucides metabolisable by the bacteria.

The elapsed time indicator may comprise a reservoir of bacteria connected by a conduit to a visual display arrangement reactive to the presence of the bacteria. For example, the activator arrangement may comprise a reservoir of bacteria connected by a conduit to a visual display arrangement reactive to the presence of the bacteria.

The elapsed time indicator may comprise a frangible element that is configured to release bacteria from the reservoir of bacteria into the conduit on opening the container for the first time. For example, the activator arrangement may comprise a frangible element that is configured to release bacteria from the reservoir of bacteria into the conduit on opening the container for the first time.

The bacteria may, for example, be contained in a fluid.

The elapsed time indicator may comprise a growth medium for the bacteria.

The growth medium may be located at the visual display arrangement or along a conduit connecting the reservoir of bacteria to the visual display arrangement.

The activator arrangement may comprise a growth medium reservoir and the visual display arrangement may comprise bacteria. The elapsed time indicator may comprise a conduit that connects the growth medium reservoir to the visual display arrangement. The activator arrangement may comprise a frangible element that is configured to release growth medium from the growth medium reservoir into the conduit on opening the container for the first time. The growth medium may, for example, be contained in a fluid.

The elapsed time indicator may comprise a piezoelectric element. For example, the activator arrangement may comprise a piezoelectric element. The piezoelectric element may comprise one or more of berlinite (AlPO4), cane sugar, quartz, Rochelle salt (sodium potassium tartrate tetrahydrate), topaz, tourmaline-group minerals, gallium orthophosphate (GaPO4), langasite (La3Ga5SiO14), ceramics with perovskite or tungsten-bronze structures, barium titanate (BaTiO3), lead titanate (PbTiO3), lead zirconate titanate (commonly known as PZT), potassium niobate (KNbO3), lithium niobate (LiNbO3), lithium tantalate (LiTaO3), sodium tungstate (Na2WO3), Ba2NaNb5O5, Pb2KNb5O15, sodium potassium niobate (NaKNb), bismuth ferrite (BiFeO3), sodium niobate NaNbO3, polyvinylidene fluoride (PVDF) and the like.

The elapsed time indicator may be configured to exert a force on the piezoelectric element on opening an associated container for the first time. For example, the activator arrangement may be configured to exert a force on the piezoelectric element on opening an associated container for the first time.

The elapsed time indicator may be configured to exert a tensile force on the piezoelectric element on opening an associated container for the first time. For example, the elapsed time indicator may comprise a first tensile member portion attached to a first face of the piezoelectric element and a second tensile member portion attached to a second face of the piezoelectric element opposite the first face of the piezoelectric element. The first tensile member portion may be arranged for attachment to a lid of the container and the second tensile member portion may be arranged for attachment to a body of the container.

The visual display arrangement may comprise an electrochromic material such as polyaniline, a viologen such as ethyl viologen, a polyoxotungstate, tungsten oxide ($WO_3$) or a liquid crystal material.

The visual display arrangement may be configured for electrolysis. The visual display arrangement may be configured to produce a gas in response to the application of an electric field thereto. The visual display arrangement may be configured to change appearance in response to the gas.

The visual display arrangement may comprise a pair of electrodes separated by a spacer medium. The electrodes and the spacer medium may, for example, be planar.

The visual display arrangement may comprise an electrolyte. For example, the spacer member may comprise an electrolyte. The spacer member may be porous and impregnated or infused with an electrolyte. Alternatively, the spacer member may contain an electrolyte in a region between a pair of electrodes.

The visual display arrangement may be configured to change appearance in response to an electrochemical reaction in the electrolyte. For example, the electrolyte may comprise a salt such as sodium chloride dissolved in water and the visual display arrangement may be configured to change appearance in response to the presence of hydrogen. The visual display arrangement may comprise palladium, PdO or Ni—Mg.

The visual display arrangement may comprise a plurality of regions, each region having a different electrolyte. For example, the visual display arrangement may comprise a plurality of regions, each region having a different concentration of a salt such as sodium chloride dissolved in water.

The visual display arrangement may comprise a front electrode and a back electrode. The front electrode may be configured to change appearance in response to an electrochemical reaction in the electrolyte.

The elapsed time indicator may comprise at least one pair of insulated conductors, each conductor providing an electrical connection between a different face of the piezoelectric element to a different one of the pair of electrodes of the visual display arrangement.

For example, the elapsed time indicator may comprise a pair of electrically conductive tracks, wires or the like. The pair of electrical conductors may be mounted on an insulating substrate. The pair of electrical conductors may be mounted on a flexible insulating substrate. For example, the pair of electrical conductors may be mounted on paper, card, or a flexible insulating plastics material, a flexible insulating polymer substrate or the like.

The elapsed time indicator may be configured such that at least one of the pair of conductors are torn, severed and/or sheared on opening the container for the first time.

According to a second aspect of the present invention there is provided a label comprising an elapsed time indicator according to the first aspect of the present invention.

It should be understood that any of the optional features relating to the first aspect of the present invention may also apply alone or in any combination in relation to the second aspect.

The label may be configured to be attached to a container. For example, the label may be configured to be attached to a jar, carton, bottle, tube, packet, package or the like.

The label may be configured to be attached to a container formed from at least one of glass, card, plastic, metal or the like.

The label may comprise an adhesive for attachment to a container.

According to a third aspect of the present invention there is provided a container comprising an elapsed time indicator according to the first aspect of the present invention.

It should be understood that any of the optional features relating to the first aspect of the present invention may also apply alone or in any combination in relation to the third aspect.

The container may be a jar, carton, bottle, tube, packet, package or the like.

The container may be formed from at least one of glass, card, plastic, metal or the like.

The container may be configured to contain various goods, such as foodstuffs, medicaments, cosmetics, chemicals, paints, sealants or the like.

According to a fourth aspect of the present invention there is provided a method of manufacturing a container comprising:

providing a container; and attaching an elapsed time indicator according to the first aspect of the present invention or a label according to the second aspect of the present invention to the container.

It should be understood that any of the optional features relating to the first aspect of the present invention may also apply alone or in any combination in relation to the fourth aspect.

The container may be a jar, carton, bottle, tube, packet, package or the like.

The container may be formed from at least one of glass, card, plastic, metal or the like.

The container may be configured to contain various goods, such as foodstuffs, medicaments, cosmetics, chemicals, paints, sealants or the like.

According to a fifth aspect of the present invention there is provided an elapsed time indicator comprising:

an activator arrangement comprising a fluid reservoir and a conduit configured to provide a predetermined flow rate of fluid along the conduit; and a visual display arrangement configured to change appearance on exposure to the fluid, wherein the conduit connects the fluid reservoir to the visual display arrangement and the activator arrangement is configured to release fluid from the fluid reservoir in response to an activation event to permit the fluid to flow.

The activator arrangement may be configured so that the activation event occurs upon relative movement of two objects for the first time.

The elapsed time indicator may be configured for attachment to both of the objects.

The elapsed time indicator may be configured for attachment to a lid and a body of a container.

The elapsed time indicator may be configured to provide an indication of the time remaining until expiry of a lifetime of the contents of the container after opening the container for the first time.

The two objects may be component parts associated with a device. For example, the two objects may be component parts of a device such as an assembly, tool, tubing string or the like configured for insertion downhole or for use in a subsea environment or the like. For example, the device may comprise an assembly, a tool, a tubing string or the like.

The elapsed time indicator may be configured for attachment to two component parts of a device.

The elapsed time indicator may be configured to provide an indication of the time remaining until expiry of a lifetime of the device or a service interval for the device. The elapsed time indicator may be configured to provide an indication of a number of units of time that have elapsed from the activation event. For example, the elapsed time indicator may be configured to provide an indication of a number of minutes, hours, days, weeks, months, years or the like that have elapsed from the activation event.

The elapsed time indicator may be configured for use with containers containing various goods, such as foodstuffs, medicaments, cosmetics, chemicals, paints, sealants or the like.

The elapsed time indicator may be configured to provide an indication of bacteria levels or levels of other organisms in food. The container may, for example, contain food and the indication of the time elapsed may, in particular, provide an indication of bacteria levels or levels of other organisms in the food.

The container may be a jar, carton, bottle, tube, packet, package or the like.

The container may be formed from at least one of glass, card, plastic, metal or the like.

The elapsed time indicator may be configured to be torn, severed, ruptured and/or sheared in response to the activation event. For example, the activator arrangement may be configured to be torn, severed, ruptured and/or sheared in response to the activation event.

The elapsed time indicator may comprise a paper, polymer or plastics substrate or a substrate formed from any other suitable material. For example, the elapsed time indicator may comprise a polymethyl methacrylate (PMMA) substrate.

The activator arrangement may comprise a first portion configured for attachment to a first object and a second portion configured for attachment to the a second object. For example, the activator arrangement may be configured for attachment to both a lid and a body of the container. The activator arrangement may comprise a lid portion configured for attachment to the lid of the container and a body portion configured for attachment to the body of the container.

The activator arrangement may comprise a tensile member which is configured for attachment between two objects and which remains stationary with respect to one of the objects to thereby exert a tensile force between the first and second portions of the elapsed time indicator in response to the activation event.

The activator arrangement may be configured to be torn, severed, ruptured and/or sheared on relative movement of the two objects for the first time.

The visual display arrangement may be configured to undergo a change in appearance according to the time elapsed from the activation event.

The visual display arrangement may be configured to undergo a change in one or more optical properties according to the time elapsed from the activation event.

The visual display arrangement may be configured to change colour according to the time elapsed from the activation event.

The visual display arrangement may be configured to undergo a change in optical transmission, absorption and/or reflection according to the time elapsed from the activation event.

The visual display arrangement may have a coloured background and the visual display arrangement may be configured to undergo a change in optical transmission, absorption and/or reflection so as to reveal or obscure the coloured background.

The visual display arrangement configured to change appearance on exposure to a fluid.

The visual display arrangement may be configured to provide an indication of a number of units of time that have elapsed from the activation event. For example, the visual display arrangement may be configured to provide an indication of a number of minutes, hours, days, weeks, months, years or the like that have elapsed from the activation event.

The visual display arrangement may comprise a plurality of regions for indicating the time elapsed from the activation event.

The visual display arrangement may comprise a plurality of regions wherein each region is configured to undergo a change in appearance after a different corresponding period of time has elapsed from the activation event.

The visual display arrangement may comprise indicia in the form of text, a numeral, and/or a symbol.

The visual display arrangement may comprise a plurality of regions wherein each region is configured to undergo the same change in appearance according to the time elapsed from the activation event.

The visual display arrangement may comprise a plurality of regions wherein each of the regions is configured to undergo the same change of colour according to the time elapsed from the activation event.

The visual display arrangement may comprise a plurality of regions wherein each region is configured to undergo a different change in appearance relative to a change in appearance of the other regions according to the time elapsed from the activation event.

The visual display arrangement may comprise a plurality of regions wherein at least one of the regions is configured to undergo a different change of colour to the other regions according to the time elapsed from the activation event.

The elapsed time indicator may be configured to provide a stimulus to the visual display arrangement in response to the activation event to initiate a reaction in the visual display arrangement. For example, the activator arrangement may be configured to provide a stimulus to the visual display arrangement in response to the activation event to initiate a reaction in the visual display arrangement. The reaction may, for example, proceed over a timescale matched to the lifetime of the contents of a container after opening the container for the first time. The reaction may, for example, proceed over a timescale matched to the lifetime or service interval of a device.

The elapsed time indicator may be configured to provide a reactant to support a reaction in the visual display arrangement. For example, the elapsed time indicator may be configured to provide a reactant to support a reaction in the visual display arrangement over a timescale matched to the lifetime of the contents of the container after opening for the first time or over a timescale matched to the lifetime or service interval of a device. For example, the activator arrangement may be configured to provide a reactant to support a reaction in the visual display arrangement over a timescale matched to the lifetime of the contents of the container after opening for the first time or over a timescale matched to the lifetime or service interval of a device.

The visual display arrangement may be configured to indicate the time elapsed from the activation event according to at least one of a chemical, biological, biochemical, electrical, electrochemical, electrochromic, chemochromic and halochromic reaction or any other kind of reaction.

The elapsed time indicator may comprise a substance capable of changing appearance according to a pH level of a fluid.

The elapsed time indicator may comprise a pH indicator dye.

The elapsed time indicator may comprise a colour former. For example, the elapsed time indicator may comprise crystal violet lactone (CVL).

The elapsed time indicator may comprise a colour former based on one or more fluorans. Such a colour former may be advantageous because it can be converted from a colourless appearance to a coloured appearance by a weak acid.

The elapsed time indicator may comprise pergascript green.

The elapsed time indicator may comprise pergascript red.

The elapsed time indicator may comprise an anthocyanin. Many anthocyanins are naturally occurring and may be toxicologically acceptable.

The elapsed time indicator may comprise a pH indicator. For example, the elapsed time indicator may comprise at least one of gentian violet (methyl violet), leucomalachite green (first transition), leucomalachite green (second transition), thymol blue (first transition), thymol blue (second transition), methyl yellow, bromophenol blue, congo red, methyl orange, bromocresol green, methyl red, methyl red/bromocresol green, azolitmin, bromocresol purple, bromothymol blue, phenol red, neutral red, naphtholphthalein, cresol red, phenolphthalein, thymolphthalein, alizarine yellow R, and litmus and the like.

The visual display arrangement may, in particular, comprise a pH indicator comprising one or more regions comprising naphtholphthalein and a region comprising phenolphthalein. This may be advantageous because naphtholphthalein changes from a colourless appearance to a pale red or a greenish-blue colour at high pH, while phenolphthalein changes from a colourless appearance to a red colour at high pH.

The elapsed time indicator may comprise a metal, for example, metal ions such as metal cations. This may be advantageous because metal cations may produce coloured compounds through reaction with an anion to form a coloured salt or through reaction with a ligand to form a coloured metal complex ion.

The elapsed time indicator may comprise a transition metal. The elapsed time indicator may comprise iron. For example, the elapsed time indicator may comprise an iron compound.

The elapsed time indicator may comprise a fluid reservoir. For example, the activator arrangement may comprise a fluid reservoir.

The fluid reservoir may contain a fluid.

The fluid reservoir may isolate a fluid from an environment external to the elapsed time indicator.

The fluid reservoir may be airtight.

The fluid may, for example, be suitable for initiating a reaction in the visual display arrangement or may be a reactant that supports a reaction in the visual display arrangement. For example, the visual display arrangement may comprise a further reactant that reacts on contact with the fluid.

The fluid may, for example, be a solution or a suspension.

The fluid may comprise particles such as micro-particles or nano-particles or the like.

The fluid may comprise a gas.

The fluid may be electrically charged or comprise charged particles such as ions, molecules or the like.

The fluid may comprise an acid, acid molecules, hydrogen ions or the like. The fluid may comprise a naturally occurring acid such as acetic or citric acid or the like. Such acids may be safe for human or animal consumption and may not be prohibited for use under food packaging or food safety regulations.

The fluid may be magnetic or comprise magnetic particles or the like.

The fluid may comprise a substance, chemical or the like.

The fluid may comprise bacteria, micro-organisms or a biological agent or the like.

The fluid may be coloured. For example, the fluid may comprise a dye or the like.

The fluid may be colourless. For example, the fluid may be colourless, but may stimulate a change in appearance of the visual display arrangement on exposure of the visual display arrangement to the fluid.

The fluid may comprise an acid and the visual display arrangement may comprise a pH indicator dye or a colour former.

The fluid may comprise a pH indicator dye or a colour former and the visual display arrangement may comprise an acid.

The elapsed time indicator may comprise a frangible element such as a frangible barrier, membrane or the like. For example, the activator arrangement may comprise a frangible element such as a frangible barrier, membrane or the like.

The frangible element may be configured to release fluid from the fluid reservoir in response to the activation event. For example, the frangible element may be broken or severed on relative movement of the two objects for the first time.

The elapsed time indicator may comprise an activator element and a complementary recess, wherein the conduit connects the fluid reservoir to the visual display arrangement, the activator element is receivable within the recess so as to prevent movement of fluid from the fluid reservoir towards the visual display arrangement and the activator element is movable within the recess so as to draw fluid from the fluid reservoir towards the conduit.

The activator element may be attached to a tensile member which is configured for attachment between two objects and which is held stationary relative to one of the two objects to thereby exert a tensile force on the activator element and move the activator element away from the recess on relative movement of the two objects for the first time so as to draw fluid from the fluid reservoir towards the conduit on relative movement of the two objects for the first time.

The activator arrangement may comprise a resilient membrane. For example, the activator arrangement may comprise a silicone membrane. The activator arrangement may be configured such that the membrane is elastically deformed when the activator element is inserted into the recess to form a seal between the membrane and a substrate of the elapsed time indicator to thereby seal the fluid in the fluid reservoir.

The activator arrangement may be configured such that movement of the activator element within the recess causes the membrane to disengage from the substrate to thereby draw fluid from the fluid reservoir towards the conduit.

The activator arrangement may comprise a flow stop element which is held in engagement with the membrane by the activator element so as to elastically deform the membrane to form a seal between the membrane and the substrate to thereby seal the fluid in the fluid reservoir.

The activator arrangement may be configured so that movement of the activator element within the recess allows the flow stop element to move in response to a restoring force arising in the elastically deformed membrane by virtue of the resilience of the membrane thereby permitting the membrane to disengage from the substrate and drawing fluid from the fluid reservoir towards the conduit.

The conduit may be configured to control a flow rate of the fluid to the visual display arrangement according to the contents of a container associated with the elapsed time indicator or according to a property of a device associated with the elapsed time indicator.

The size and/or shape of the conduit may be chosen to control a flow rate of the fluid to the visual display arrangement. In particular, the length and/or cross-section of the conduit may be chosen to control a flow rate of the fluid to the visual display arrangement.

In at least one embodiment, the conduit may have a cross-section that varies along the length of the conduit.

The cross-sectional variation of the conduit may be configured to at least partially establish the predetermined flow rate.

The conduit may comprise a plurality of first portions each having a greater cross-section and a plurality of second portions each having a lesser cross-section, wherein adjacent first portions are connected by a respective second portion. Such a conduit may retard the flow of fluid along the conduit between the fluid reservoir and the visual display arrangement, thus enabling the production of an elapsed time indicator capable of indicating elapsed time periods of greater duration. Such a conduit may, in particular, retard the flow of fluid along the conduit to such an extent so as to enable the production of an elapsed time indicator capable of indicating elapsed time periods of several days or weeks.

The conduit may, for example, have a uniform thickness and may comprise a plurality of wider portions and a plurality of narrower portions, wherein adjacent wider portions are connected by a respective narrower portion. The narrower portions may be linear and/or curved.

The material from which the conduit is formed may be chosen to control a flow rate of the fluid to the visual display arrangement.

The fluid may be chosen to control a flow rate of the fluid to the visual display arrangement. For example, a more viscous fluid may be chosen to reduce the flow rate of the fluid to the visual display arrangement or a less viscous fluid may be chosen to increase the flow rate of the fluid to the visual display arrangement.

The conduit may comprise a capillary and the released fluid may be drawn through the conduit under capillary action.

The conduit may comprise a microfluidic channel.

The conduit may comprise a porous material such as a porous paper or a porous polymer or the like. For example, the conduit may comprise filter paper.

The conduit may comprise a porous strip.

The conduit may comprise one or more microfibres.

The conduit may have a thickness of between 100 nm and 100 mm, of between 1 μm and 10 mm, or between 10 μm and 1 mm. The conduit may have a thickness substantially equal to 100 μm. Such conduit thicknesses may ensure that a fluid moves along the conduit by capillary action.

The conduit may comprise a porous strip having a uniform thickness, a plurality of wider pad portions and a plurality of narrower channel portions, wherein adjacent pad portions are connected by a respective channel portion. The narrower portions may be linear and/or curved.

In at least one embodiment, the conduit may comprise a porous strip sealed between polymer layers. For example, the conduit may comprise a porous strip sealed between polymethyl methacrylate (PMMA) layers.

The conduit may be isolated or sealed from an environment external to the conduit. For example, the conduit may be airtight.

When the conduit and the fluid reservoir are both airtight, the activator arrangement may be configured so that movement of an activator element within a recess formed within a substrate of the elapsed time indicator causes a reduction in local pressure between the fluid reservoir and the conduit thereby drawing fluid from the fluid reservoir into, towards or into communication with the conduit.

The elapsed time indicator may comprise a network of conduits connecting the fluid reservoir to a visual display arrangement comprising a plurality of regions.

The elapsed time indicator may comprise a visual display arrangement wherein the visual display arrangement is maintained at a pressure less than atmospheric pressure when the container is unopened.

The elapsed time indicator may comprise a frangible element that is configured to release a fluid into a conduit connecting the fluid reservoir to a reduced pressure visual display arrangement in response to the activation event. For example, the activator arrangement may comprise a frangible element that is configured to release a fluid into a conduit connecting the fluid reservoir to a reduced pressure visual display arrangement on relative movement of two objects for the first time. Such an arrangement results in the released fluid moving towards the visual display arrangement under the action of a pressure differential on relative movement of the two objects for the first time to either initiate or supply a reaction in the visual display arrangement.

The elapsed time indicator may comprise a device for attracting a fluid. For example, the activator arrangement may comprise a device for attracting the fluid towards the visual display arrangement.

For example, the elapsed time indicator may comprise a magnet and the fluid may be magnetic. For example, the fluid may comprise a magnetic material, a magnetic liquid, magnetic particles or the like.

The elapsed time indicator may comprise a battery and the fluid may be electrically charged. For example, the activator arrangement may comprise a battery and the fluid may be electrically charged. The fluid may comprise electrically charged particles, ions, molecules or the like.

The elapsed time indicator may comprise a conduit connecting the device for attracting a fluid to the fluid reservoir.

The elapsed time indicator may comprise a network of conduits connecting the device for attracting a fluid and a visual display arrangement to the fluid reservoir. For example, the network of conduits may comprise a conduit connecting the device for attracting a fluid to the fluid reservoir and a further conduit connecting the conduit to the visual display arrangement. The network of conduits may comprise a conduit connecting the device for attracting a fluid to the fluid reservoir and a plurality of further conduits, each further conduit connecting the conduit to a respective region of the visual display arrangement.

The elapsed time indicator may comprise bacteria and a visual display arrangement configured to change appearance in response to the presence of the bacteria at the visual display arrangement.

The bacteria may be staphylococcus, or a coliform such as *escherichia coli* (*E. coli*).

The visual display arrangement may be configured to change colour in response to the presence of the bacteria at the visual display arrangement. The visual display arrangement may comprise a growth medium for the bacteria.

The visual display arrangement may comprise a chemical, biological, biochemical, chemochromic or halochromic reagent or any other kind of reagent.

The visual display arrangement may comprise a source of amino acids chosen from the group consisting of meat peptones, vegetable peptones, casein hydrolysates, tryptose, tryptones and yeast extract.

The visual display arrangement may comprise a source of glucides chosen from monometric or oligomeric glucides metabolisable by the bacteria.

The elapsed time indicator may comprise a reservoir of bacteria connected by a conduit to a visual display arrangement reactive to the presence of the bacteria. For example, the activator arrangement may comprise a reservoir of bacteria connected by a conduit to a visual display arrangement reactive to the presence of the bacteria.

The elapsed time indicator may comprise a frangible element that is configured to release bacteria from the reservoir of bacteria into the conduit in response to the activation event. For example, the activator arrangement may comprise a frangible element that is configured to release bacteria from the reservoir of bacteria into the conduit on relative movement of two objects for the first time.

The bacteria may, for example, be contained in a fluid.

The elapsed time indicator may comprise a growth medium for the bacteria.

The growth medium may be located at the visual display arrangement or along a conduit connecting the reservoir of bacteria to the visual display arrangement.

The activator arrangement may comprise a growth medium reservoir and the visual display arrangement may comprise bacteria. The elapsed time indicator may comprise a conduit that connects the growth medium reservoir to the visual display arrangement. The activator arrangement may comprise a frangible element that is configured to release growth medium from the growth medium reservoir into the conduit in response to the activation event. The growth medium may, for example, be contained in a fluid.

According to a sixth aspect of the present invention there is provided an elapsed time indicator comprising:

an activator arrangement comprising a fluid reservoir, a conduit, an activator element and a complementary recess; and a visual display arrangement configured to change appearance on exposure to the fluid, wherein the conduit connects the fluid reservoir to the visual display arrangement, the activator element is receivable within the recess so as to prevent movement of fluid from the fluid reservoir towards the visual display arrangement and the activator element is movable within the recess so as to draw fluid from the fluid reservoir towards the visual display arrangement.

It should be understood that any of the optional features relating to the fifth aspect of the present invention may also apply alone or in any combination in relation to the sixth aspect.

According to a seventh aspect of the present invention there is provided an elapsed time indicator comprising:

an activator arrangement comprising a fluid reservoir and a conduit; and a visual display arrangement configured to change appearance on exposure to the fluid, wherein the conduit connects the fluid reservoir to the visual display arrangement and the activator arrangement is configured to release fluid from the fluid reservoir in response to an activation event to permit the fluid to flow and the fluid or the visual display arrangement comprises a colour former.

The elapsed time indicator may comprise crystal violet lactone (CVL).

The elapsed time indicator may comprise a colour former based on one or more fluorans.

The elapsed time indicator may comprise pergascript green.

The elapsed time indicator may comprise pergascript red.

It should be understood that any of the optional features relating to the fifth aspect of the present invention may also apply alone or in any combination in relation to the seventh aspect.

According to an eighth aspect of the present invention there is provided a label comprising an elapsed time indicator according to the fifth, sixth or seventh aspect of the present invention.

It should be understood that any of the optional features relating to the fifth, sixth or seventh aspect of the present invention may also apply alone or in any combination in relation to the eighth aspect.

The label may be configured to be attached to a container. For example, the label may be configured to be attached to a jar, carton, bottle, tube, packet, package or the like.

The label may be configured to be attached to a container formed from at least one of glass, card, plastic, metal or the like.

The label may comprise an adhesive for attachment to a container.

According to a ninth aspect of the present invention there is provided a container comprising an elapsed time indicator according to the fifth, sixth or seventh aspect of the present invention.

It should be understood that any of the optional features relating to the fifth, sixth or seventh aspect of the present invention may also apply alone or in any combination in relation to the ninth aspect.

The container may be a jar, carton, bottle, tube, packet, package or the like.

The container may be formed from at least one of glass, card, plastic, metal or the like.

The container may be configured to contain various goods, such as foodstuffs, medicaments, cosmetics, chemicals, paints, sealants or the like.

According to a tenth aspect of the present invention there is provided a method of manufacturing a container comprising:

providing a container; and attaching an elapsed time indicator according to the fifth, sixth or seventh aspect of the present invention or a label according to the eighth aspect of the present invention to the container.

It should be understood that any of the optional features relating to the fifth, sixth or seventh aspect of the present invention may also apply alone or in any combination in relation to the tenth aspect.

The container may be a jar, carton, bottle, tube, packet, package or the like.

The container may be formed from at least one of glass, card, plastic, metal or the like.

The container may be configured to contain various goods, such as foodstuffs, medicaments, cosmetics, chemicals, paints, sealants or the like.

BRIEF DESCRIPTION OF THE DRAWINGS

The present invention will now be described by way of non-limiting example only with reference to the following figures of which:

FIG. 3(*b*) is a cross-section on AA of the portion of the activator arrangement of FIG. 3(*a*);

FIG. 5(*b*) is a cross-section on AA of the portion of the activator arrangement of FIG. 5(*a*);

FIG. 13(*b*) is a schematic cross-section on AA of FIG. 13(*a*);

FIG. 16(*b*) is an image of the first, second and third porous paper strips of FIG. 16(*a*) several hours after exposure of the adjacent ends of the strips to the coloured fluid;

FIG. 17(*b*) is a plot of the location of 10%, 50% and 100% colour intensity fluid fronts along the strip FIG. 17(*a*) as a function of time;

FIG. 18(*b*) is a plot of the location of the 10% colour intensity fluid front along each of the strips of FIG. 18(*a*) as a function of time.

DETAILED DESCRIPTION OF THE DRAWINGS

Figure 1:
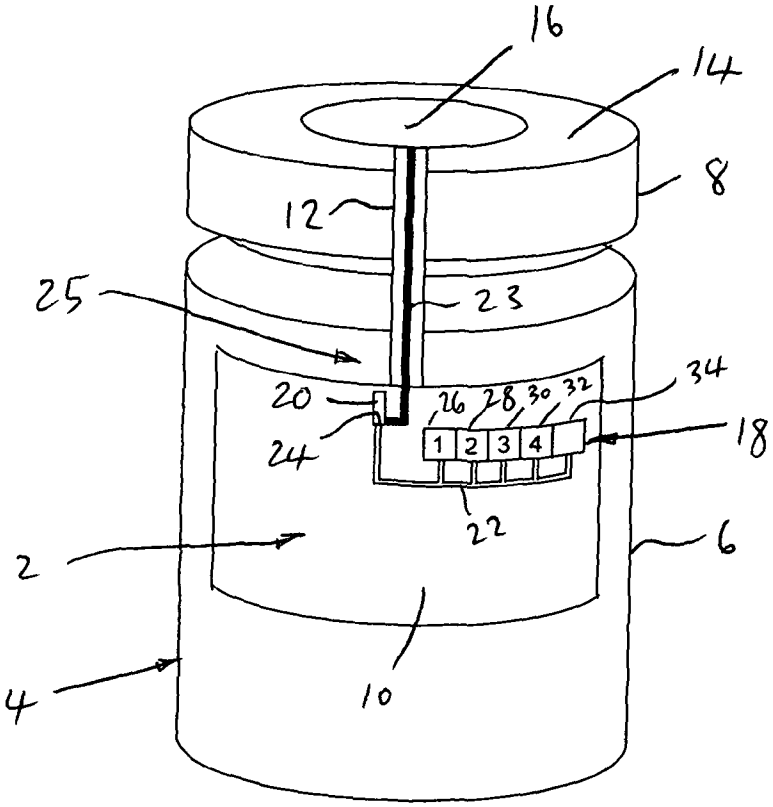
FIG. 1 is a schematic perspective view of a sealed jar comprising a label, the label constituting a first embodiment of the present invention.

FIGS. 1 through 5 illustrate a first embodiment of an elapsed time indicator. Referring initially to FIG. 1, there is shown an elapsed time indicator in the form of a label generally designated 2 attached to a sealed jar generally designated 4. In the embodiment shown, the sealed jar 4 comprises a glass body 6 and a lid 8. The lid 8 is fixed to the body 6 by a screw coupling as is commonly known in the art. The label 2 comprises a body portion 10 that is configured to be adhered to the jar body 6, and a tag portion 12 which extends from the label body portion 10. The tag portion 12 is configured to extend between the body 6 and lid 8 of the jar 4. In use, as shown in FIG. 1, the label tag portion 12 is attached to an upper surface 14 of the lid 8 by an adhesive sticker 16.

The label body portion 10 further comprises a visual display arrangement in the form of a pH indicator 18 and a fluid reservoir 20 of acetic acid 21 connected by a network of capillaries 22. The tag portion 12 comprises a tensile member 23 attached at one end to a frangible barrier 24 that seals the fluid reservoir 20 and separates the acetic acid 21 contained in the fluid reservoir 20 from the capillary network 22. Together the fluid reservoir 20, the capillary network 22, the tensile member 23 and the frangible barrier 24 comprise an activator arrangement generally designated 25.

The fluid reservoir 20, the capillary network 22 and the pH indicator 18 are configured to ensure that the pH indicator 18 provides a visual indication of the time elapsed from opening of the jar 4 for the first time. For example, the concentration or pH of the acetic acid 21 in the fluid reservoir 20, the size and shape of the capillary network 22 and the sensitivity of the pH indicator 18 are configured to induce an appropriate colour change of the pH indicator 18 over a timescale associated with the lifetime of the contents of the jar 4 after opening for the first time.

The pH indicator 18 comprises five different regions 26, 28, 30, 32 and 34. Each successive region 26, 28, 30, 32 and 34 is positioned successively further from the fluid reservoir 20. Thus, region 26 is configured to undergo a colour change earlier than region 28 etc and the colour change of each successive region 26, 28, 30, 32 and 34 may indicate that a successively longer period of time has elapsed since opening the container for the first time. Regions 26, 28, 30 and 32 may be labelled with sequence numbers "1", "2", "3" and "4" respectively, to indicate the passage of 1, 2, 3 or 4 units of time respectively since opening of the container for the first time. The last region 34 is reserved to indicate that the lifetime associated with the contents of the container after opening for the first time has been exceeded and that the contents should not be consumed or used. To emphasise this, the last region 34 is configured to show a different colour change to each of the other regions 26, 28, 30 and 32 of the pH indicator 18. Each region 26, 28, 30 and 32 is configured to turn green on expiry of a period of 1, 2, 3 or 4 units of time from opening the container for the first time respectively, while region 34 is configured to turn red after expiry of a period of 4 units of time from opening the container for the first time. In the particular embodiment shown in FIGS. 1 through 5, the regions 26, 28, 30 and 32 each comprise pergascript green, whereas the last region 34 comprises pergascript red. Furthermore, it will be understood by one skilled in the art that, as described in more detail below, the capillary network 22 is arranged to provide a predetermined flow of the acid 21 towards the regions 26, 28, 30, 32 and 34 of the pH indicator 18 after opening the jar 4 for the first time. In particular, the capillary network 22 is configured to provide a relatively slow flow of acid, whereas each region 26, 28, 30, 32 and 34 of the pH indicator 18 is configured to provide a relatively rapid change in colour on exposure to the acid 21. In the particular embodiment shown in FIGS. 1 to 5, the capillary network 22 is configured to provide a flow of acid 21 on a timescale of several days or more, whereas each region 26, 28, 30, 32 and 34 of the pH indicator 18 is configured to provide a colour change within a timescale of hours or minutes of the acid 21 reaching an edge of the respective region 26, 28, 30, 32 or 34.

Figure 2:
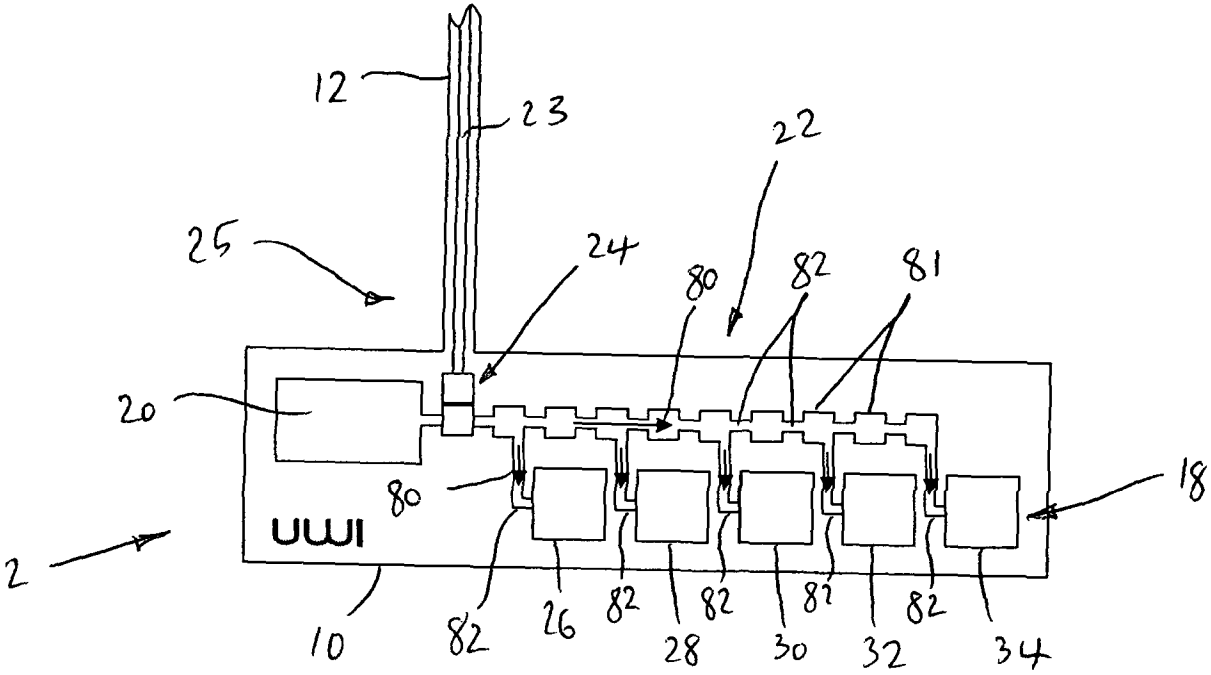
FIG. 2 is a detailed front view of the label of FIG. 1.

As shown in more detail in FIG. 2, the capillary network 22 comprises a 100 μm thick porous paper strip which extends from a position adjacent to the frangible barrier 24 to each of the regions 26, 28, 30, 32 and 34 of the pH indicator 18. The paper strip 22 is configured for movement of fluid 21 from the fluid reservoir 20 under capillary action in a direction generally indicated by arrows 80. The paper strip 22 comprises a series of pad portions 81 and a series of linear channel portions 82, wherein adjacent pad portions 81 are interconnected by linear channel portions 82. The pad portions 81 of the paper strip 22 have a length Lp in the direction 80 of fluid movement and a width denoted Wp in a direction lateral to the direction 80 of fluid movement. The channel portions 82 of the paper strip 22 have a width Wc in a direction lateral to the direction of fluid movement. The pad portion width Wp is greater than the channel portion width Wc. In the example shown in FIG. 2, adjacent pad portions 81 are separated by 2.5 mm, Lp is 3 mm, Wp is 3 mm and Wc is 300 μM. Experimental data described below has shown that such a porous paper strip 22 having alternate pad portions 81 and channel portions 82, wherein the pad portions 81 are of greater width than the channel portions 82 may provide a controllable flow of fluid such as the acid 21 on a significantly longer timescale than a porous paper strip of the same material and thickness but having a constant width equal to that of the pad portions 81, or a porous paper strip of the same material and thickness but having a constant width equal to that of the channel portions 82.

Figure 3:
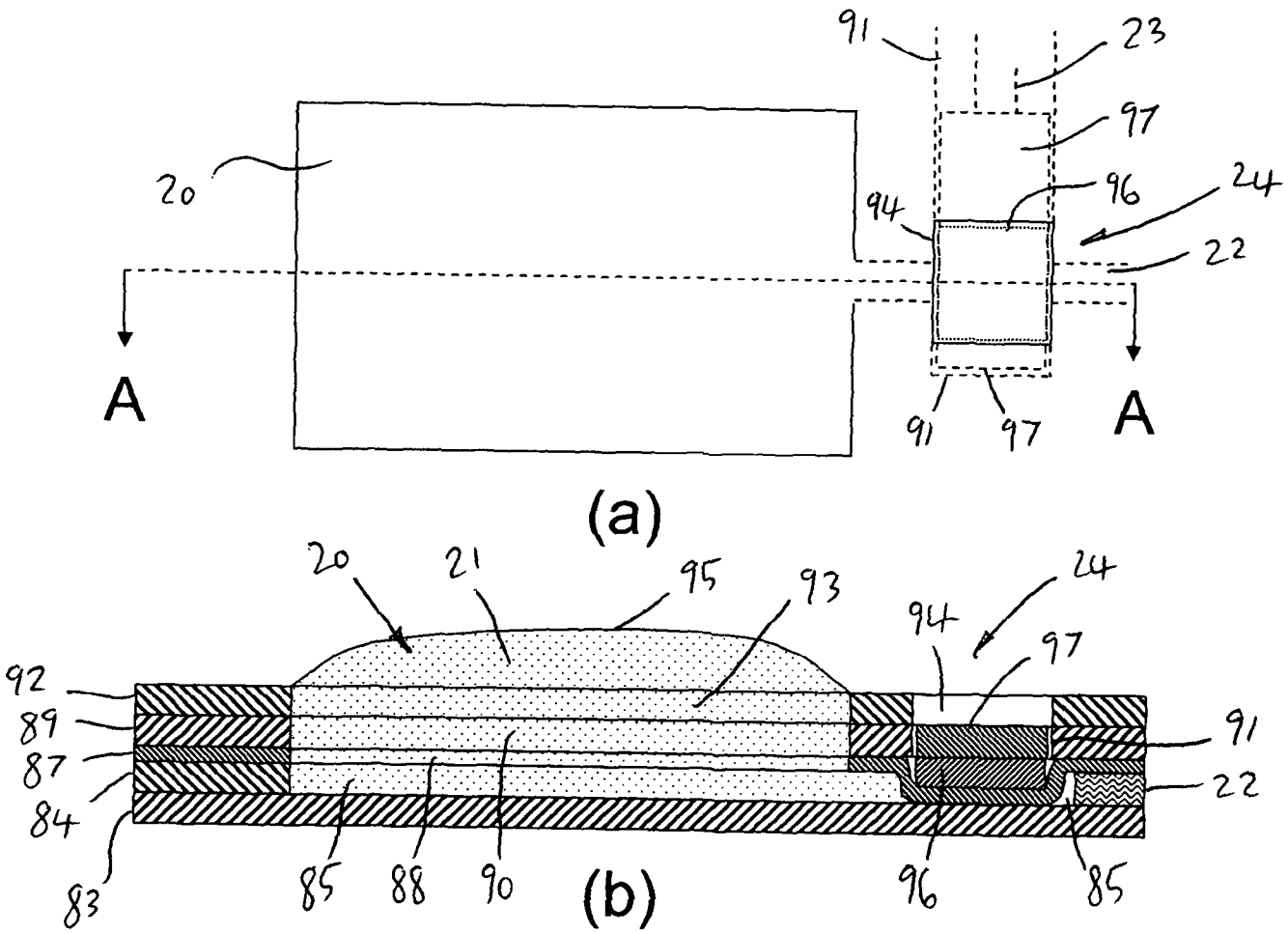
FIG. 3(*a*) is a detailed front view of a portion of an activator arrangement of FIG. 2.

With reference to FIGS. 3(*a*) and (*b*), the fluid reservoir 20 and the frangible barrier 24 are formed as a multilayer structure on a polymethyl methacrylate (PMMA) substrate 83. A PMMA capillary layer 84 is formed on top of the substrate 83. The capillary layer 84 has a recess 85 formed therein. The recess 85 is configured to define a portion of the fluid reservoir 20 and to define a sealed airtight space which accommodates the paper strip 22 between the substrate 83 and a 100 μm thick resilient silicone activator membrane layer 87 formed on an upper surface of the capillary layer 84. The activator membrane layer 87 has a recess 88 formed therein so as to define a portion of the fluid reservoir 20. A PMMA activator layer 89 is formed on top of the activator membrane layer 87. The activator layer 89 has a reservoir recess 90 formed therein so as to define a portion of the fluid reservoir 20. The activator layer 89 also has a laterally extending activator member recess 91 formed therein. A PMMA cap layer 92 is formed on top of the activator layer 89. The cap layer 92 has a reservoir recess 93 formed therein so as to define a portion of the fluid reservoir 20. The cap layer 92 also has an activator member recess 94 formed therein. The fluid reservoir 20 is filled with the acid 21 and is sealed by a sealing membrane 95.

The frangible barrier 24 further comprises a flow stop element 96 and an activator element 97 which is attached to the end of the tensile strip 23. The flow stop element 96 is inserted from above through the recess 94 in the cap layer 92 until it engages the activator membrane layer 87. Subsequently, downward pressure is applied to the flow stop element 96 to displace the flow stop element 96 downwardly into the recess 85 in the capillary layer 84 and thereby deform a portion of the activator membrane layer 87 downwardly into the recess 85 until the activator membrane layer 87 engages the substrate 83. With the downward pressure still applied to the flow stop element 96, the activator element 97 is inserted laterally into the recess 91 in the activator layer 89 so as to extend across the top of the flow stop element 96 and trap the flow stop element 96 in its displaced position within the recess 85 in the capillary layer 84 as shown in FIG. 3(*b*). With the flow stop element 96 in this displaced position, the activator membrane layer 87 forms a seal between the flow stop element 96 and the substrate 83 so as to prevent flow of acid 21 from the fluid reservoir 20 towards the paper strip 22.

Figure 4:
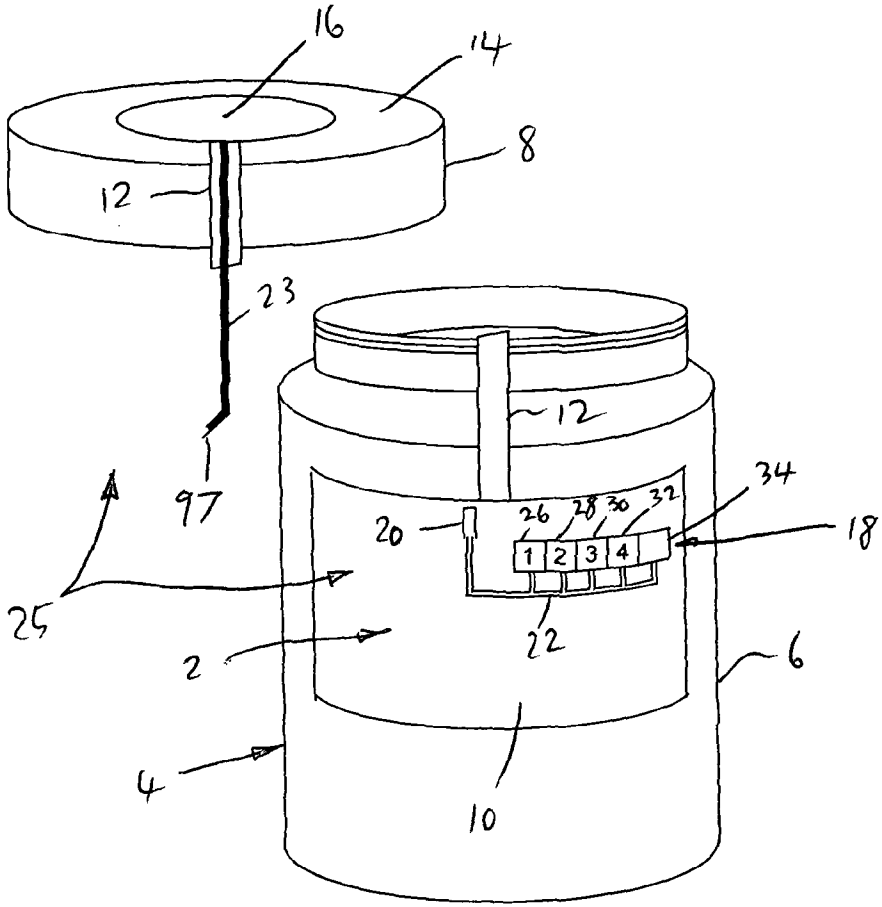
FIG. 4 is a schematic perspective view of the jar of FIG. 1 after opening by removing a lid.
Figure 5:
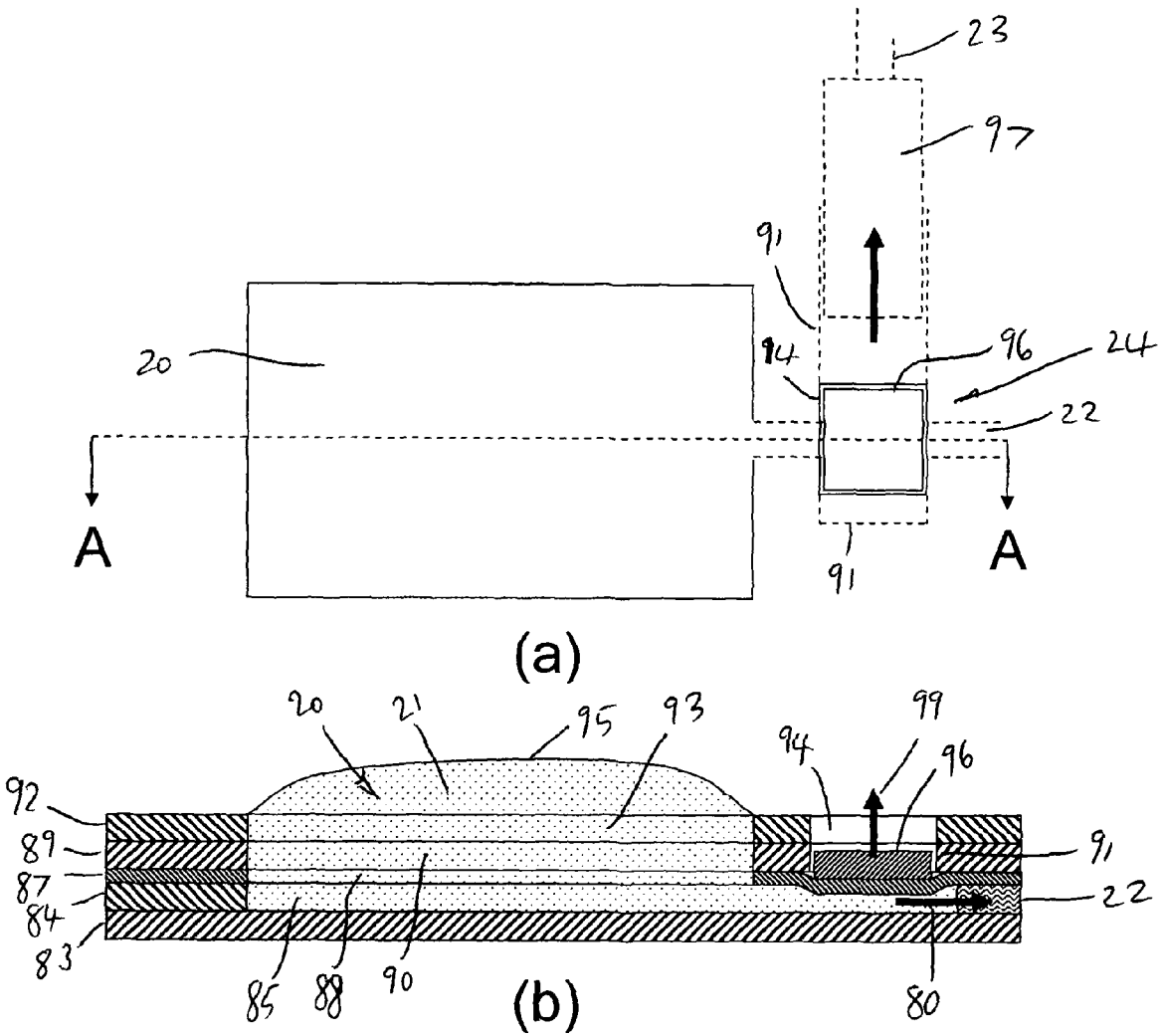
FIG. 5(*a*) is a detailed front view of the portion of the activator arrangement of FIG. 3(*a*) during opening of the jar.

With reference to FIG. 4, on opening the jar, the tensile member 23 becomes separated from the label body portion 10 thereby breaking the frangible barrier 24 and releasing acetic acid from the fluid reservoir 20 into the capillary network 22 as described in more detail with reference to FIGS. 5(*a*) and 5(*b*). As the tensile member 23 is pulled away from the label body portion 10, the activator element 97 remains attached to the end of the tensile member 23 and is pulled laterally out of the activator recess 91 as indicated by the arrow 98 in FIG. 5(*a*) to uncover the flow stop element 96 below. Consequently, the flow stop element 96 moves upwardly under the action of the resilience of the activator membrane 87 as indicated by the arrow 99 in FIG. 5(*b*) and the activator membrane 87 disengages from the substrate 83 to break the seal formed therewith. Since the reservoir 20 is sealed and the paper strip 22 is contained within a sealed airtight space, the upward movement of the activator membrane 87 results in a local pressure drop drawing the acid 21 from the reservoir 20 under the portion of the activator membrane 87 located underneath the flow stop element 96 until the acid 21 in the reservoir 20 is brought into communication with the paper strip 22 as indicated by the arrow 80. The acetic acid 21 is subsequently drawn along the paper strip 22 under capillary action towards the pH indicator 18.

Figure 6:
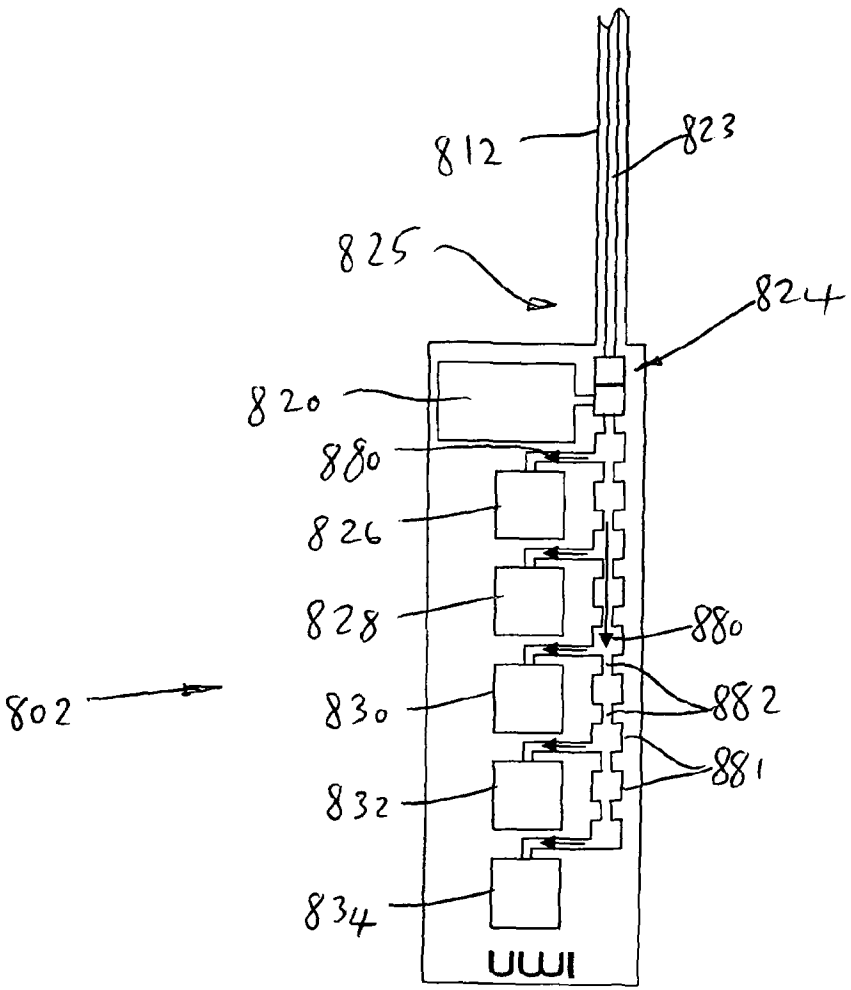
FIG. 6 is a detailed front view of a label constituting a second embodiment of the present invention.

FIG. 6 shows a second embodiment of a label 802 which differs from the label 2 shown in FIG. 2 only in layout of the features. The label 802 shares many like features with label 2 and like features are identified with like reference numerals. Unlike the label 2 which is configured for attachment to a container such as a jar in a horizontal orientation, the label 802 is configured for attachment to a container in a vertical orientation.

Figure 7:
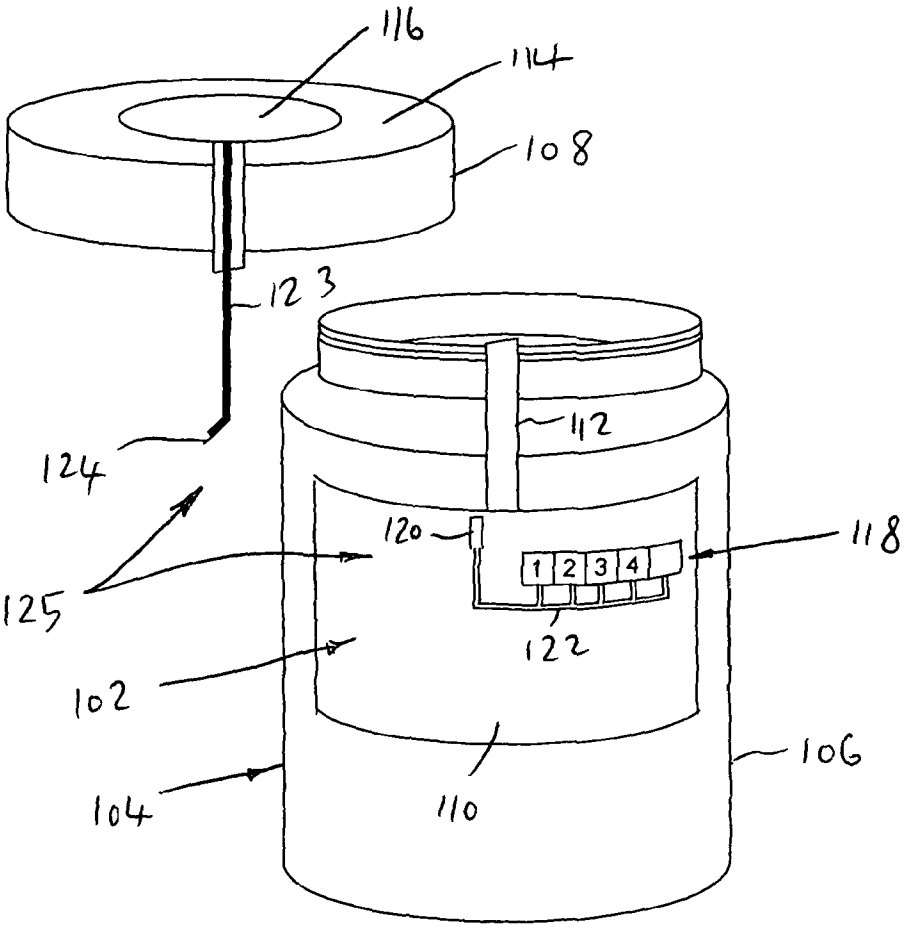
FIG. 7 is a schematic perspective view of a jar after opening by removing a lid, the jar comprising a label which constitutes a third embodiment of the present invention.

FIG. 7 shows a third embodiment of the present invention which has many of the same features as the first embodiment of FIGS. 1 through 5 and, as such, like features are identified with like reference numerals. A label 102 of FIG. 7 is attached to a jar 104 and only differs from the label 2 of FIGS. 1 through 5 in that a capillary network 122 of FIG. 7 is maintained at a pressure below the pressure of acetic acid 121 in a reservoir 120 prior to opening the jar 104 for the first time. On opening the jar 104 for the first time, a tag portion 112 of the label 102 is torn and a tensile member 123 exerts a tensile force on a frangible barrier 124 of the fluid reservoir 120 so as to break the frangible barrier 124. This results in the acetic acid 121 being drawn into the capillary network 122 and towards a pH indicator 118 under the action of the pressure differential. Together the fluid reservoir 120, the capillary network 122, the tensile member 123 and the frangible barrier 124 comprise an activator arrangement generally designated 125.

Figure 8:
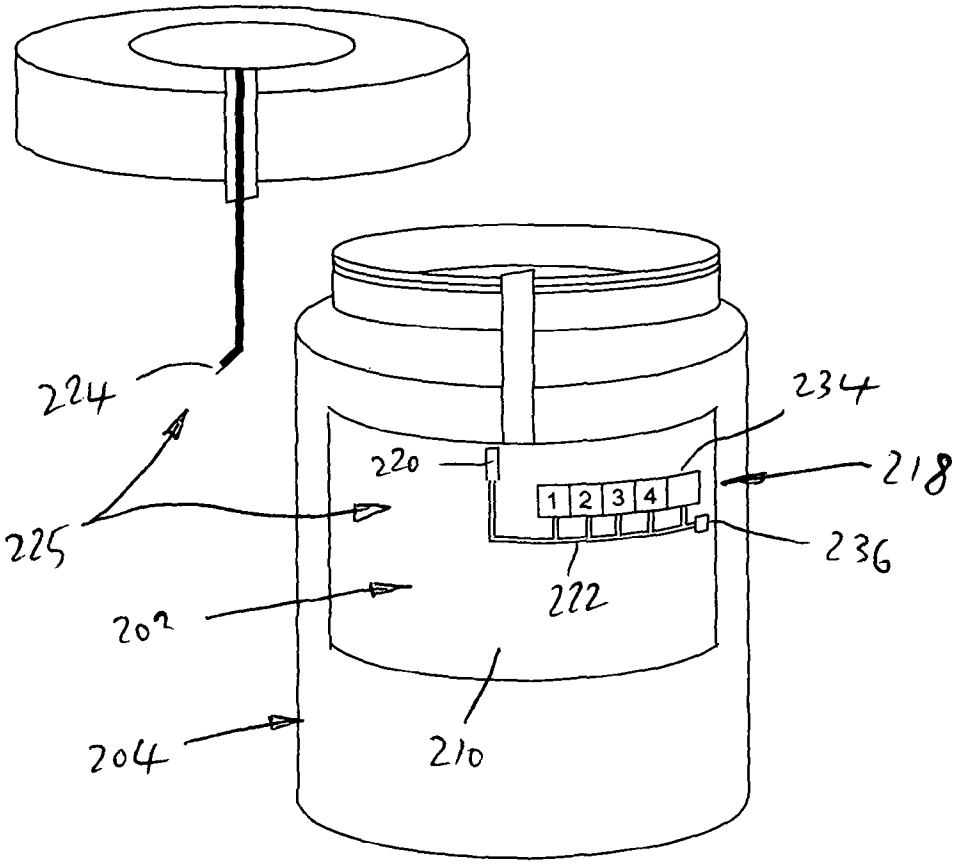
FIG. 8 is a schematic perspective view of a jar after opening by removing a lid, the jar comprising a label which constitutes a fourth embodiment of the present invention.

FIG. 8 shows a fourth embodiment of the present invention which has many of the same features as the first embodiment of FIGS. 1 through 5 and, as such, like features are identified with like reference numerals. A label 202 of FIG. 8 is attached to a jar 204 and differs from the label 2 of FIGS. 1 through 5 in that a body portion 210 of the label 202 of FIG. 8 includes a magnet 236 located adjacent to a distal end region 234 of a pH indicator 218 and the fluid 221 stored in a fluid reservoir 220 comprises acetic acid and magnetic iron particles. On opening the jar 204 for the first time, a tag portion 212 of the label 202 is torn and a tensile member 223 exerts a tensile force on a frangible barrier 224 of a fluid reservoir 220 so as to break the frangible barrier 224. The magnetic iron particles serve to draw the fluid 221 along a capillary network 222 towards the magnet 236 and therefore towards the pH indicator 218 when the jar 204 is opened for the first time. Together the fluid reservoir 220, the capillary network 222, the tensile member 223, the frangible barrier 224 and the magnet 236 constitute an activator arrangement generally designated 225.

Figure 9:
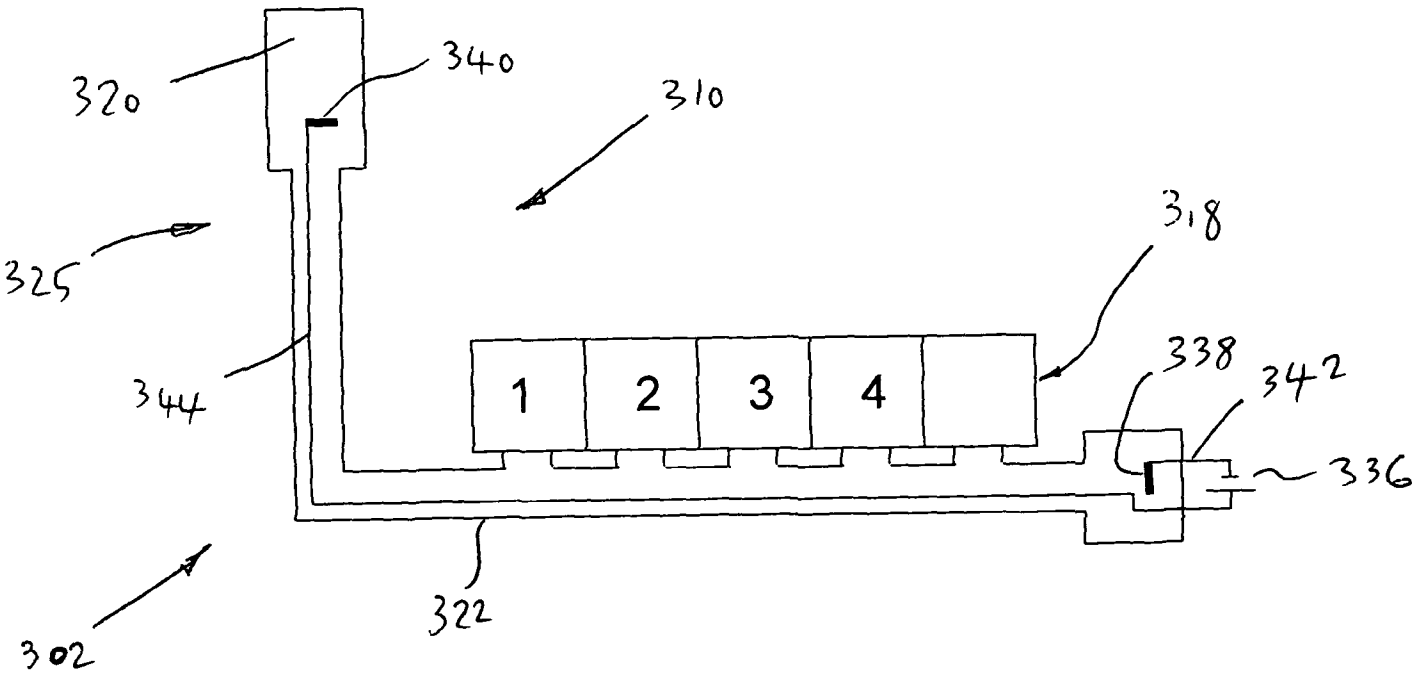
FIG. 9 is a schematic of a portion of a label after opening a jar comprising the label, the label constituting a fifth embodiment of the present invention.

FIG. 9 shows a fifth embodiment of the present invention which has many of the same features as the first embodiment of FIGS. 1 through 5 and, as such, like features are identified with like reference numerals. A label 302 of FIG. 9 is attached to a jar (not shown) and differs from the label 2 of FIGS. 1 through 5 in that a body portion 310 of the label 302 includes a battery 336 connected to a negative electrode 338 and a positive electrode 340 via electrical conductors 342 and 344 respectively. On opening the jar (not shown) for the first time, a tag portion (not shown) of the label 302 is torn and a tensile member (not shown) exerts a tensile force on a frangible barrier (not shown) of a fluid reservoir 320 so as to break the frangible barrier (not shown). The electric field created by the arrangement of the battery 336 and the electrodes 338, 340 serves to attract H+ ions of acetic acid 321 through a capillary network 322 towards the negative electrode 338 and therefore towards a pH indicator 318 when the jar (not shown) is opened for the first time. Together the fluid reservoir 320, the capillary network 322, the tensile member (not shown), the frangible barrier (not shown), the battery 336 and the electrodes 338, 340 constitute an activator arrangement generally designated 325.

Figure 10:
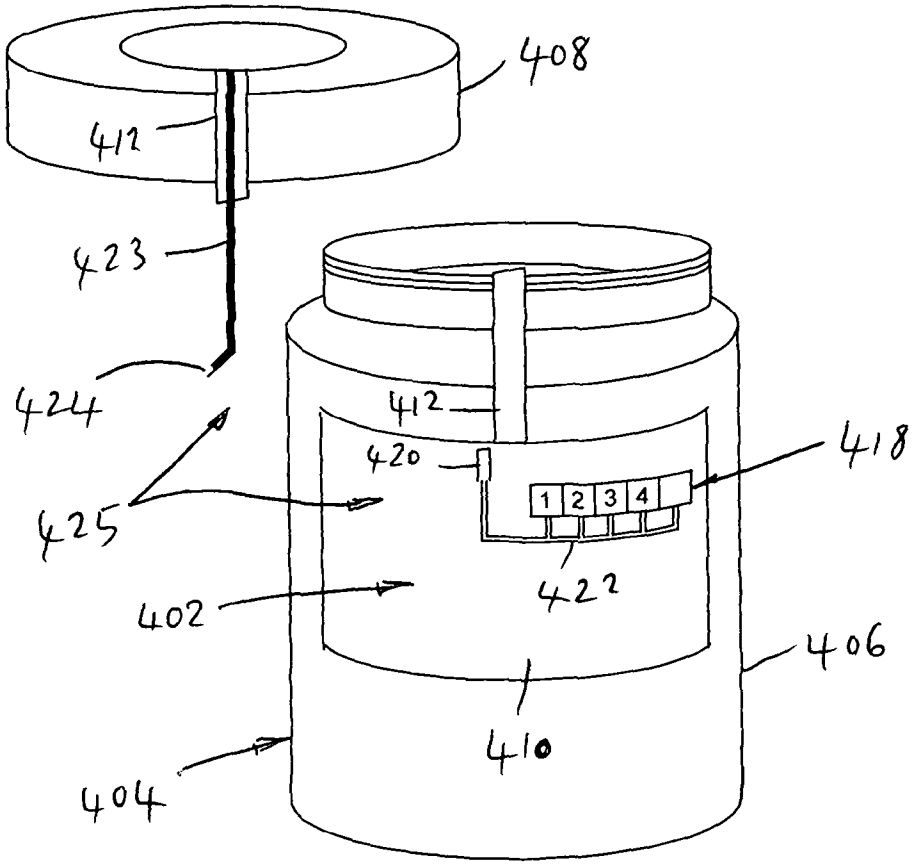
FIG. 10 is a schematic perspective view of a jar after opening by removing a lid, the jar comprising a label which constitutes a sixth embodiment of the present invention.

FIG. 10 shows a fifth embodiment of the present invention which has many of the same features as the first embodiment of FIGS. 1 through 5 and, as such, like features are identified with like reference numerals. A label 402 of FIG. 10 is attached to a jar 404 and differs from the label 2 of FIGS. 1 through 5 in that a fluid reservoir 420 contains a fluid 421 comprising staphylococcus bacteria and a visual display arrangement 418 is configured to change colour according to the presence of staphylococcus bacteria at the visual display arrangement 418. The visual display arrangement 418 comprises a growth medium for the bacteria in the form of a source of amino acids chosen from the group consisting of meat peptones, vegetable peptones, casein hydrolysates, tryptose, tryptones and yeast extract and a source of glucides chosen from monometric or oligomeric glucides metabolisable by the bacteria. The visual display arrangement 418 further comprises a halochromic reagent that changes colour according to the concentration of bacteria at the visual display arrangement 418. On opening the jar 404 for the first time, a tag portion 412 of the label 402 is torn and a tensile member 423 exerts a tensile force on a frangible barrier 424 of the fluid reservoir 420 so as to break the frangible barrier 424 and release the fluid 221 comprising staphylococcus bacteria into a capillary network 422. Together the fluid reservoir 420, the capillary network 422, the tensile member 423 and the frangible barrier 424 constitute an activator arrangement generally designated 425.

Figure 11:
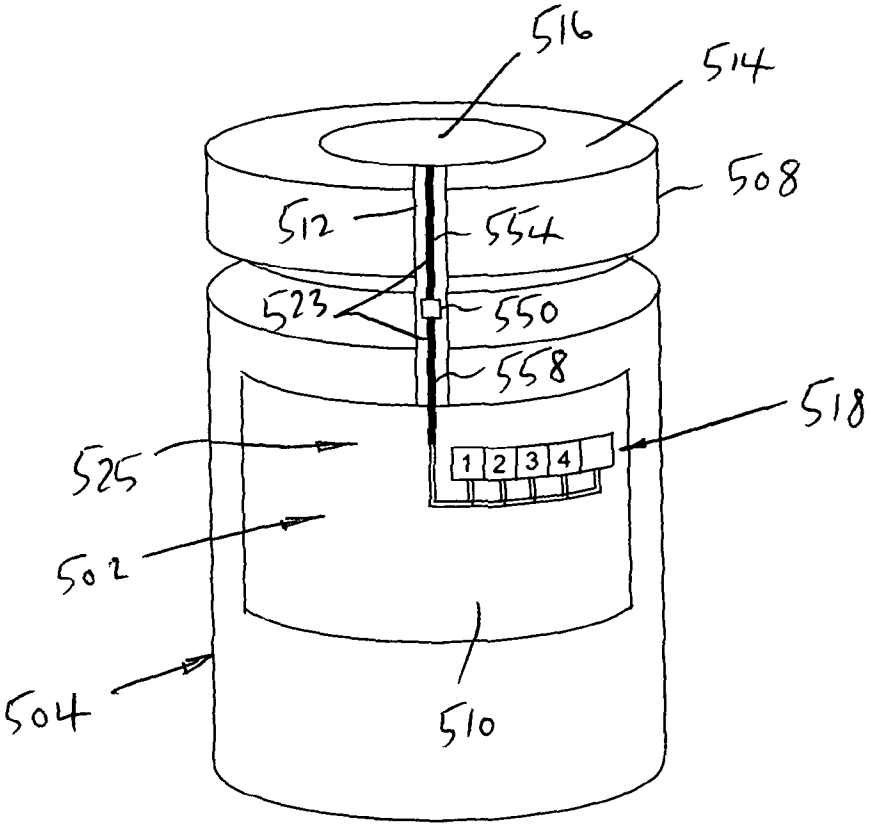
FIG. 11 is a schematic perspective view of a sealed jar comprising a label, the label constituting a seventh embodiment of the present invention.
Figure 12:
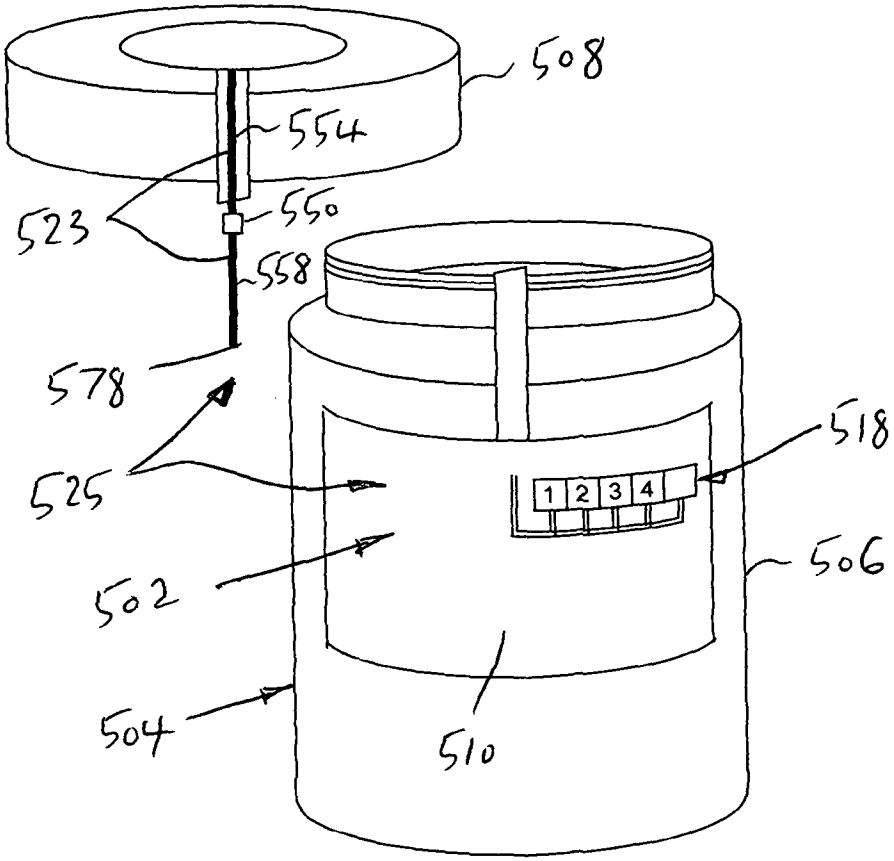
FIG. 12 is a schematic perspective view of the jar of FIG. 11 after opening by removing a lid.
Figure 13:
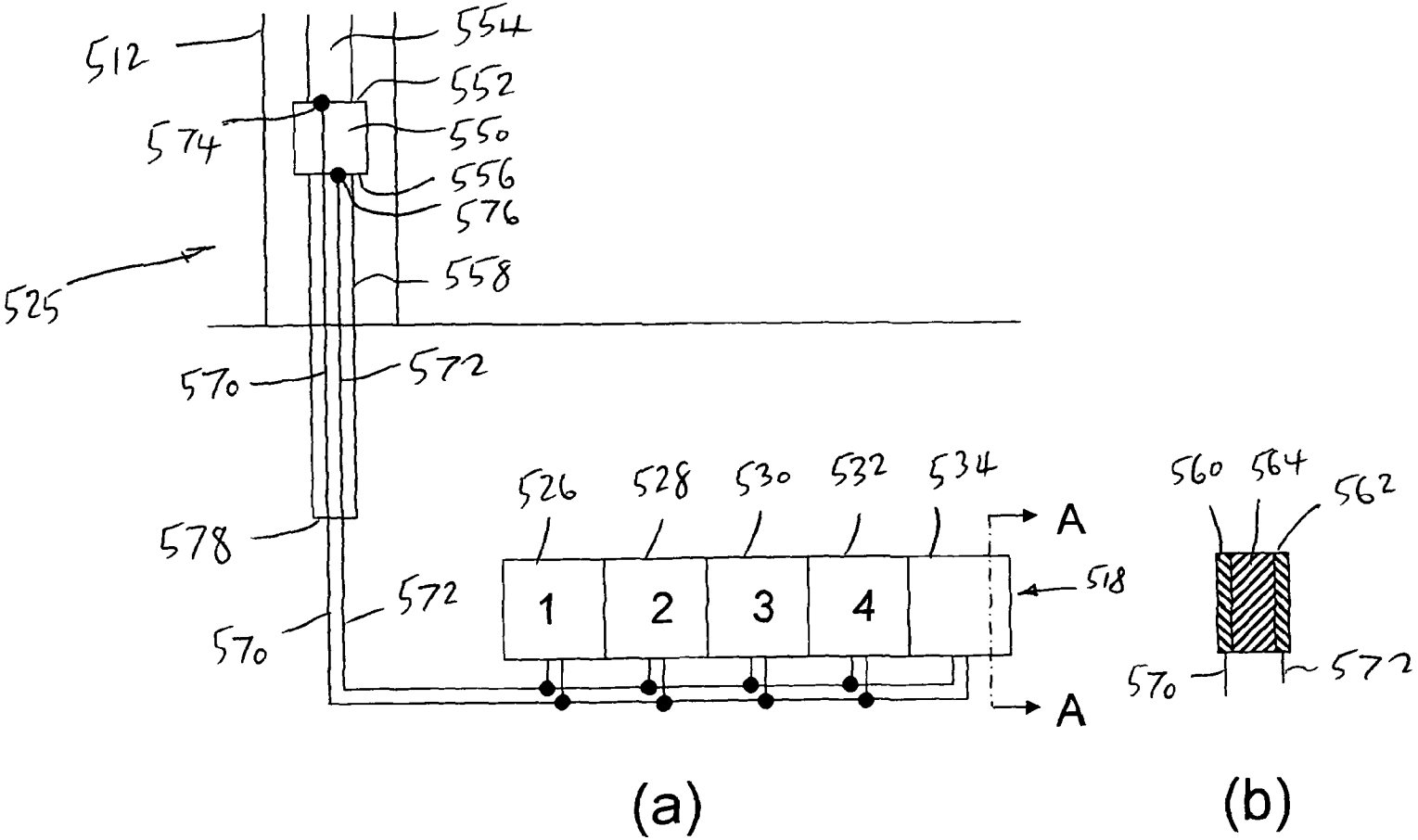
FIG. 13(*a*) is a schematic of a portion of the label of FIG. 11 before opening the jar.

FIGS. 11 to 13 show a sixth embodiment of the present invention which has many of the same features as the first embodiment of FIGS. 1 through 5 and, as such, like features are identified with like reference numerals. The embodiment of FIGS. 11 to 13 differs from the first embodiment of FIGS. 1 through 5 in that a label 502 of FIGS. 11 to 13 comprises a lead zirconate titanate (PZT) member 550. As shown most clearly in FIG. 13(*a*), an upper face 552 of the PZT member 550 is attached to an upper portion 554 of a tensile member 523. Similarly, a lower face 556 of the PZT member 550 is attached to a lower portion 558 of the tensile member 523.

With reference to FIG. 13(*b*), each region 526, 528, 530, 532 and 534 of a visual display arrangement 518 comprises a front planar electrode 560, a back planar electrode 562 and a spacer medium 564 arranged in the plane of the label body portion 510. The spacer medium 564 separates the electrodes 560, 562 and comprises an electrolyte comprising sodium chloride (NaCl) dissolved in water. Furthermore, the spacer medium 564 is porous to allow movement of the electrolyte between the planar electrodes 560, 562. The spacer medium 564 in each region 526, 528, 530, 532 and 534 comprises NaCl present in a different concentration. More specifically, the concentration of NaCl present in each region 526, 528, 530, 532 and 534 is successively reduced from a first predetermined NaCl concentration in region 526 to a second predetermined NaCl concentration in region 534, wherein the first and second predetermined NaCl concentrations are determined in accordance with a lifetime of the contents of the jar 504 after opening the jar 504 for the first time. Furthermore, the front electrode 560 in each region 526, 528, 530, 532 and 534 comprises palladium and is arranged to change appearance according to the concentration of hydrogen gas generated at the front electrode 560.

The label 502 further comprises first and second insulated electrical conductors 570 and 572. The first conductor 570 forms an electrical connection between a point 574 on the upper face 552 of the PZT member 550 and an electrode in each of the regions 526, 528, 530, 532 and 534 of the visual display arrangement 518. Similarly, the second conductor 572 forms an electrical connection between a point 576 on the lower face 556 of the PZT member 550 and a corresponding electrode in each of the each of the regions 526, 528, 530, 532 and 534.

As the lid 508 is removed but before separation of the lid 508 from the container body 506, the PZT member 550 is subjected to a tensile force as the upper portion 554 of the tensile member 523 is urged away from the lower portion 558 of the tensile member 523 thus generating an electric potential between the faces 552 and 556 of the PZT member 550. The electrical potential thus generated is applied across the electrodes in each of the regions 526, 528, 530, 532 and 534 causing electrolysis and the generation of hydrogen gas at the front electrode 560 in each of the regions 526, 528, 530, 532 and 534 until such time as the lid 508 is moved so far from the container body 506 that the electrical conductors 570 and 572 are severed at positions aligned with an end 578 of the tensile member 523 as shown in FIGS. 12 and 13(*a*). As a result of the severing of the electrical conductors 570 and 572, further generation of hydrogen gas is prevented when the lid 508 is subsequently refitted to the body 506 of the jar 504. Together the tensile member 523, the PZT member 550 and the electrical conductors 570, 572 constitute an activator arrangement generally designated 525.

It should be understood that the embodiments described herein are merely exemplary and that modifications may be made thereto without departing from the scope of the present invention. For example, although each of the visual display arrangements 18, 118, 218, 318, 418, 518 has five regions, the number of regions of the visual display arrangement may be more or less than five. Furthermore, a region of the visual display arrangement may comprise a label in the form of text, a numeral, and/or a symbol. Alternatively, a region of the visual display arrangement may comprise no such label.

In a modification of the sixth embodiment of FIGS. 11 to 13, rather than relying on electrolysis in each of the regions 526, 528, 530, 532 and 534, each of the regions 526, 528, 530, 532 and 534 may comprise polyaniline present in different amounts in accordance with the lifetime of the contents of the jar 504 after opening of the jar 504 for the first time. The polyaniline in each of the regions 526, 528, 530, 532 and 534 is arranged to change colour gradually after application of an electric potential. On opening the jar 504 for the first time, the PZT member 550 generates an electric potential which is applied to the polyaniline in each of the regions 526, 528, 530, 532 and 534 thus causing a different colour change in each region.

Figure 14:
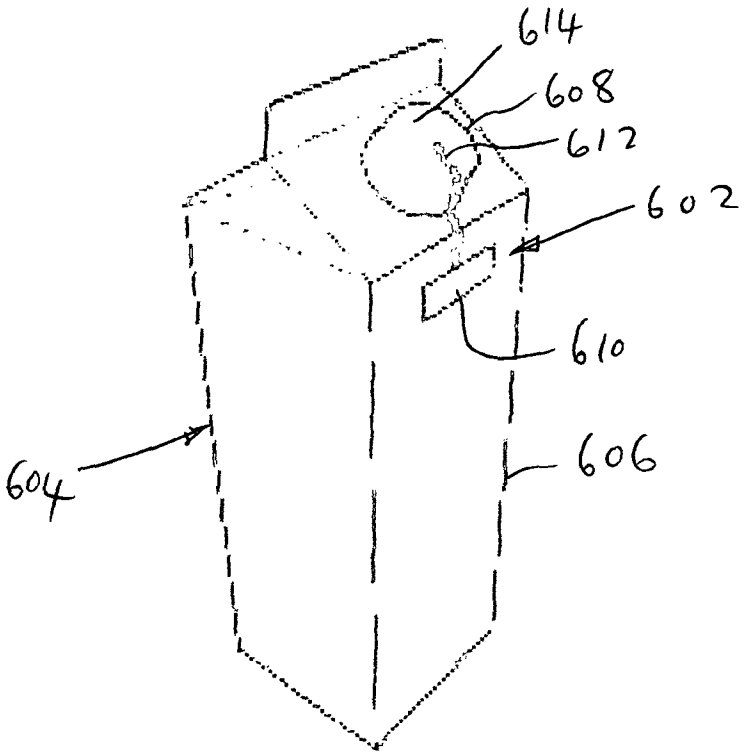
FIG. 14 is a schematic perspective view of a carton comprising a label, the label constituting an eighth embodiment of the present invention.

In other embodiments, the container may be a carton, bottle, tube, packet, package or the like. For example, FIG. 14 shows an elapsed time indicator in the form of a label generally designated 602 attached to a carton generally designated 604. In the embodiment shown, the carton 604 comprises a body 606 and a lid 608. The lid 608 is fixed to the body 606 by a screw coupling as is commonly known in the art. The label 602 comprises a body portion 610 that is configured to be adhered to the carton body 606, and a tag portion 612 which extends from the body portion 610. The tag portion 612 is configured to extend between the body 606 and lid 608 of the carton 604. In use, the label tag portion 612 is attached to an upper surface 614 of the lid 608 and remains with the lid 608 after removal of the lid 608 from the body 606.

Figure 15:
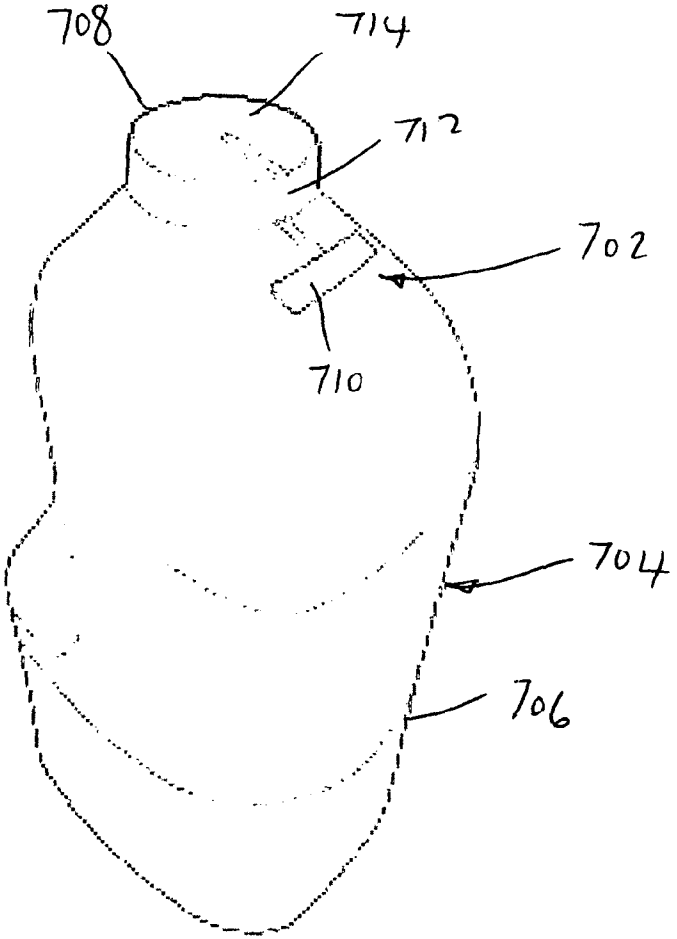
FIG. 15 is a schematic perspective view of a bottle comprising a label, the label constituting a ninth embodiment of the present invention.

Similarly, FIG. 15 shows an elapsed time indicator in the form of a label generally designated 702 attached to a bottle generally designated 704. In the embodiment shown, the bottle 704 comprises a body 706 and a lid 708. The lid 708 is fixed to the body 706 by a screw coupling as is commonly known in the art. The label 702 comprises a body portion 710 that is configured to be adhered to the carton body 706, and a tag portion 712 which extends from the body portion 710. The tag portion 712 is configured to extend between the body 706 and lid 708 of the bottle 704. In use, the label tag portion 712 is attached to an upper surface 714 of the lid 708 and remains with the lid 708 after removal of the lid 708 from the body 706.

The Applicant has discovered that it is possible to control the movement of fluid due to capillary action along a conduit:

Example 1

Figure 16:
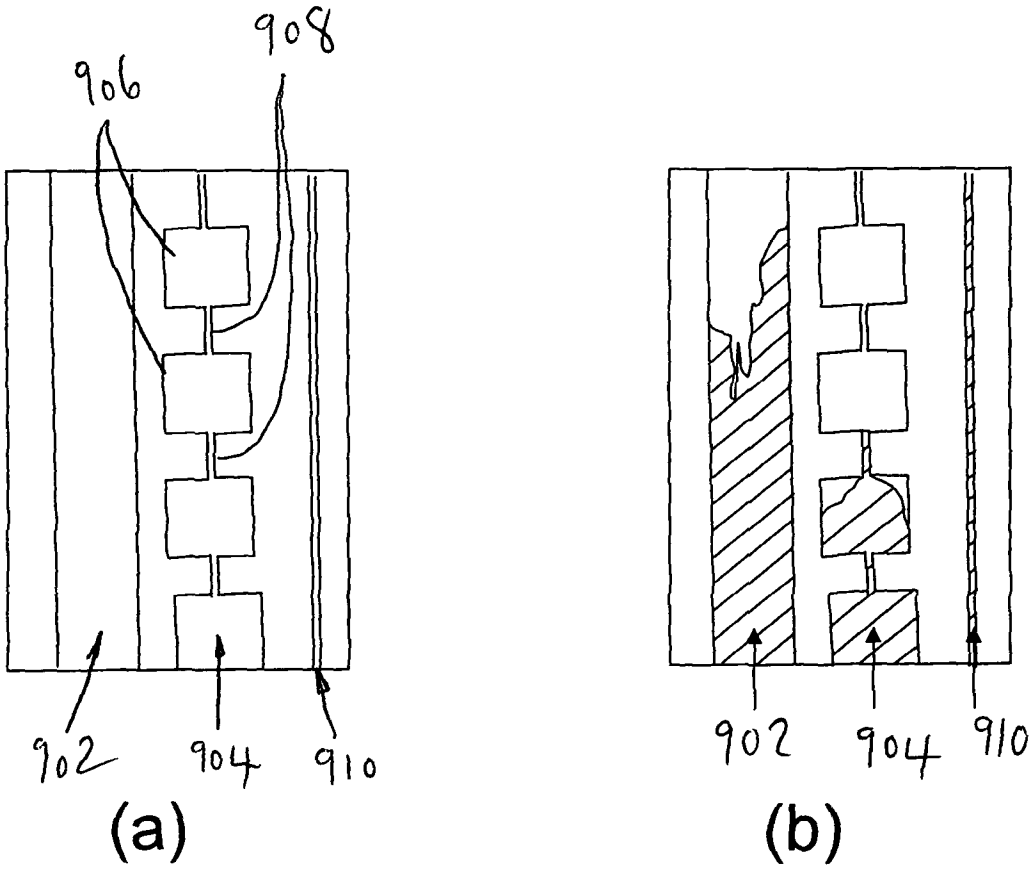
FIG. 16(*a*) is an image of first, second and third porous paper strips having different configurations prior to exposure of adjacent ends of the strips to a coloured fluid.

With reference to the experimental results of FIGS. 16(*a*) and 16(*b*), the Applicant has discovered that a capillary network comprising a porous paper strip having alternate pad portions and channel portions, wherein the pad portions are of greater width than the channel portions may provide a controllable flow of fluid on a significantly longer timescale than a porous paper strip of the same material and thickness but having a constant width equal to that of the pad portions or a porous paper strip of the same material and thickness but having a constant width equal to that of the channel portions.

FIG. 16(*a*) shows a first porous paper strip 902 having a thickness of 100 μm and a uniform width of 5 mm, a second porous paper strip 904 having a thickness of 100 μm and a series of 5 mm square pad portions 906 separated by linear channel portions 908 which are 300 μm long and 200 μm wide, and a third porous paper strip 910 having a thickness of 100 μm and a uniform width of 200 μm. Adjacent ends of the first, second and third porous paper strips 902, 904 and 910 at the bottom of the image shown in FIG. 16(*a*) were each simultaneously exposed to a coloured fluid. As a consequence of capillary action, the coloured fluid was drawn along the first, second and third porous paper strips 902, 904 and 910 and, after several hours, the image shown in FIG. 16(*b*) of the porous paper strips 902, 904 and 910 was taken indicating that the strip 904 having the alternating pad and channel portions 906, 908 resulted in slower movement of the coloured fluid than either the strip 902 having a uniform width equal to that of the pad portions 906 of the strip 904 or the strip 910 having a uniform width equal to that of the channel portions 908 of the strip 904. It should be understood that the coloured fluid advanced along the entire length of the third porous paper strip 910 shown in FIG. 16(*b*) and that, in the interests of clarity, the outline of the third porous paper strip 910 has been marked in FIG. 16(*b*).

The results of FIG. 16(*b*) demonstrate that a porous paper strip having alternating pad and channel portions may be used to slow or reduce the movement of fluid due to capillary action along the porous paper strip.

Example 2

Figure 17:
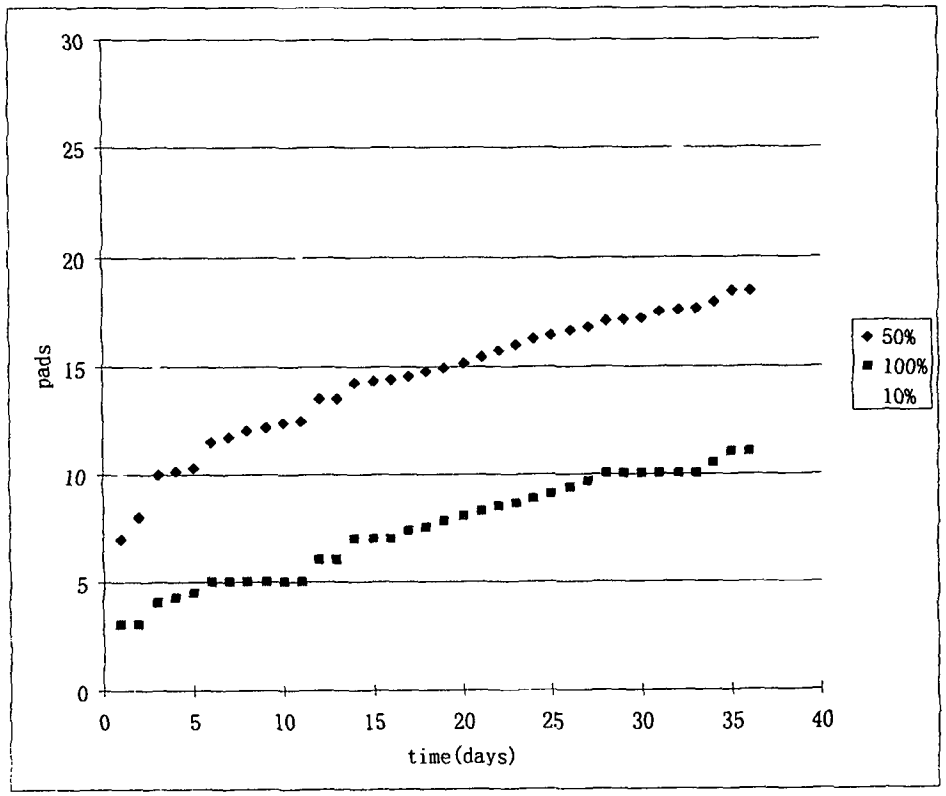
FIG. 17(*a*) is an image of a serpentine porous paper strip prior to exposure of one end of the strip to a coloured fluid.
Figure 17:
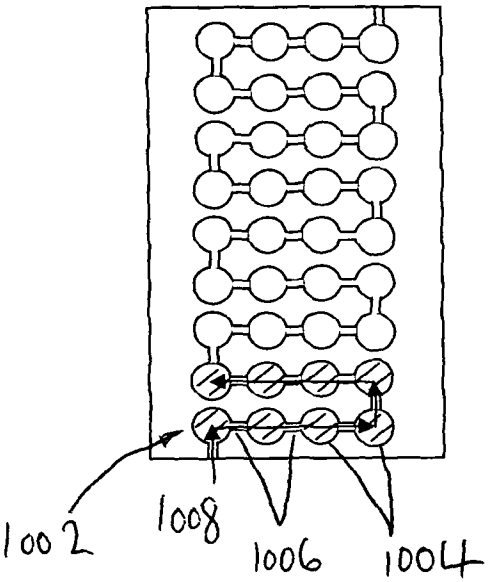

With reference to the experimental results of FIGS. 17(*a*) and 17(*b*), the Applicant has discovered that a capillary network comprising a porous paper strip having alternate pad portions and channel portions, wherein the pad portions are of greater width than the channel portions may provide a flow of fluid over timescales of several days.

FIG. 17(*a*) shows a porous paper strip 1002 having a thickness of 100 μm and a series of 3 mm diameter circular pad portions 1004 separated by linear channel portions 1006 which are 2.5 mm long and approximately 700 μm wide. An end 1008 of the porous paper strip 1002 was exposed to a coloured fluid. As a consequence of capillary action, the coloured fluid was drawn along the porous paper strip 1002 and images of the porous paper strip 1002 were taken at intervals over a period of 36 days from first exposure of the end 1008 of the porous paper strip 1002 to the coloured fluid.

The data of FIG. 17(*b*) was extracted from the images of the porous paper strip 1002 as follows. Image processing techniques were used to extract from each image the location of 10%, 50% and 100% colour intensity values along the strip 1002 relative to a colour intensity of the coloured fluid in a reservoir adjacent to the end 1008 of the porous paper strip 1002 at the time of first exposure of the end 1008 of the porous paper strip 1002 to the coloured fluid. The progress of the resulting colour change in the direction of fluid movement along the strip 1002 is plotted in FIG. 17(*b*) for the 10%, 50% and 100% colour intensity values. In each case, the distance of the location of the fluid front in the direction of fluid movement along the strip 1002 is expressed as a fractional pad number and is plotted against the time expressed in days. Thus, from the results of FIG. 17(*b*), it is clear that a 10% colour intensity fluid front advanced to a distal side of the $15^{th}$ pad over a period of three to four days, whereas the 50% colour intensity fluid front advanced to a distal side of the $10^{th}$ pad and the 100% colour intensity fluid front advanced to a distal side of the $4^{th}$ pad over the same approximate time period.

The results of FIG. 17(*b*) demonstrate that a capillary network comprising a porous paper strip having alternate pad portions and channel portions, wherein the pad portions are of greater width than the channel portions, may provide a flow of fluid along the porous paper strip due to capillary action over timescales of several days.

Example 3

Figure 18:
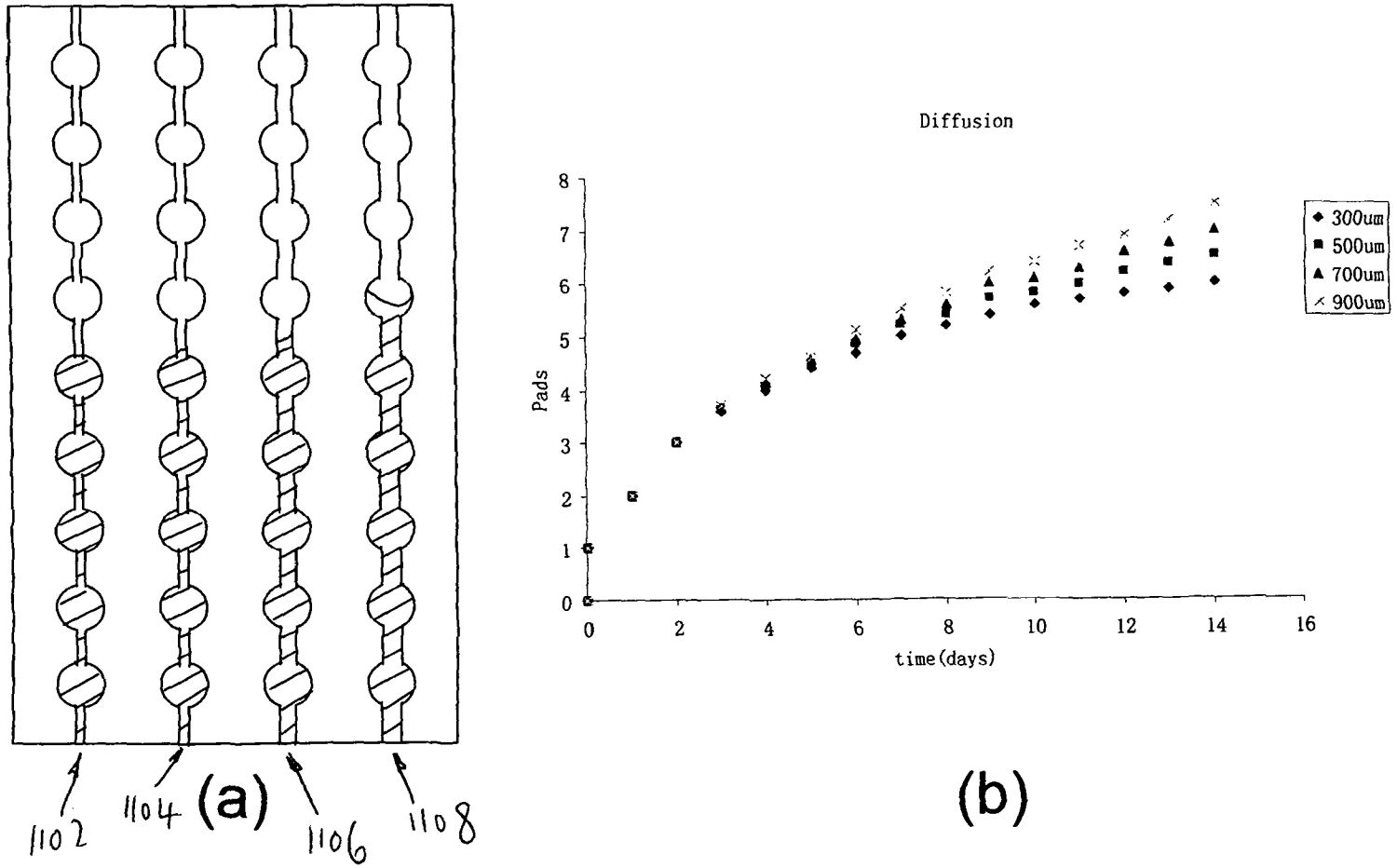
FIG. 18(*a*) is an image of first, second, third and fourth porous paper strips having different configurations prior to exposure of adjacent ends of the strips to a coloured fluid.

With reference to the experimental results of FIGS. 18(*a*) and 18(*b*), the Applicant has discovered that it is possible to use a capillary network comprising a porous paper strip having alternate pad portions and channel portions, wherein the pad portions are of greater width than the channel portions, to provide a controllable flow of fluid over timescales of several days.

FIG. 18(*a*) shows first, second, third and fourth porous paper strips 1102, 1104, 1106 and 1108 respectively each having a thickness of 100 μm and a series of 3 mm diameter circular pad portions separated by linear channel portions which are 2.5 mm long. The linear channel portions of the paper strips 1102, 1104, 1106 and 1108 have widths of 300, 500, 700 and 900 μm respectively. Adjacent ends of the porous paper strips 1102, 1104, 1106 and 1108 at the bottom of the image shown in FIG. 18(*a*) were each simultaneously exposed to a coloured fluid. As a consequence of capillary action, the coloured fluid was drawn along the porous paper strips 1102, 1104, 1106 and 1108 and images of the porous paper strips 1102, 1104, 1106 and 1108 were taken at intervals over a period of 14 days from first exposure of the respective ends of the porous paper strips 1102, 1104, 1106 and 1108 to the coloured fluid. The data of FIG. 18(*b*) was extracted from the images of the porous paper strips 1102, 1104, 1106 and 1108 as follows. Image processing techniques were used to extract from each image the location of a 10% colour intensity fluid front along each of the porous paper strips 1102, 1104, 1106 and 1108 relative to a colour intensity of the coloured fluid in a reservoir adjacent to the ends of the porous paper strips 1102, 1104, 1106 and 1108 at the time of first exposure of the adjacent ends of the porous paper strips 1102, 1104, 1106 and 1108 to the coloured fluid. The progress of the resulting colour change in the direction of fluid movement along the strips 1102, 1104, 1106 and 1108 is plotted in FIG. 18(*b*) for the 10% colour intensity fluid front. The distance of the 10% colour intensity fluid front location in the direction of fluid movement along each strip 1102, 1104, 1106 and 1108 is expressed as a fractional pad number and is plotted against the time expressed in days. Thus, from the results of FIG. 18(*b*), it is clear that the speed at which the 10% colour intensity fluid front advances along the respective porous paper strips 1102, 1104, 1106 and 1108 increases as the channel width is increased over the range from 300 to 900 μm.

The results of FIG. 18(*b*) demonstrate that the configuration of a capillary network comprising a porous paper strip having alternate pad portions and channel portions, wherein the pad portions are of greater width than the channel portions, may be altered to provide a controllable flow of fluid along the porous paper strip due to capillary action over timescales of several days.

The invention claimed is:

1. An elapsed time indicator configured for attaching to a container, the elapsed time indicator comprising:

an activator arrangement comprising a fluid reservoir and a conduit configured to provide a predetermined flow rate of fluid along the conduit; and a visual display arrangement configured to change appearance on exposure to the fluid, wherein the conduit connects the fluid reservoir to the visual display arrangement and the activator arrangement is configured to release fluid from the fluid reservoir in response to opening the container for the first time to permit the fluid to flow, and wherein the conduit has a cross-section that varies along the length of the conduit so as to at least partially establish the predetermined flow rate.

2. An elapsed time indicator according to claim 1, wherein the elapsed time indicator is configured for attachment to a lid and a body of the container.

3. An elapsed time indicator according to claim 2, wherein the elapsed time indicator is configured to provide an indication of the time remaining until expiry of a lifetime of the contents of the container after opening the container for the first time.

4. An elapsed time indicator according to claim 1, wherein the conduit comprises a plurality of first portions each having a greater cross-section and a plurality of second portions each having a lesser cross-section, wherein adjacent first portions are connected by a respective second portion.

5. An elapsed time indicator according to claim 4, wherein the conduit has a uniform thickness and comprises a plurality of wider portions and a plurality of narrower portions, wherein adjacent wider portions are connected by a respective narrower portion.

6. An elapsed time indicator according to claim 5, wherein the narrower portions are linear and/or curved.

7. An elapsed time indicator according to claim 1, wherein the conduit comprises a porous material.

8. An elapsed time indicator according to claim 7, wherein the conduit comprises porous paper or porous polymer.

9. An elapsed time indicator according to claim 1, wherein the conduit comprises one or more microfibres.

10. An elapsed time indicator according to claim 1, wherein the conduit has a thickness between 10 μm and 1 mm.

11. An elapsed time indicator according to claim 1, wherein the conduit has a thickness substantially equal to 100 μm.

12. An elapsed time indicator according to claim 1, wherein the conduit comprises a porous strip having a uniform thickness, a plurality of wider pad portions and a plurality of narrower channel portions, wherein adjacent pad portions are connected by a respective channel portion.

13. An elapsed time indicator according to claim 1, wherein the conduit comprises a porous strip sealed between polymer layers.

14. An elapsed time indicator according to claim 1, comprising an activator element and a complementary recess, wherein the activator element is receivable within the recess so as to prevent movement of fluid from the fluid reservoir towards the visual display arrangement and the activator element is movable within the recess so as to draw fluid from the fluid reservoir towards the conduit.

15. An elapsed time indicator according to claim 14 comprising a tensile member configured for attachment between the two objects and which is held stationary relative to one of the two objects to thereby exert a tensile force on the activator element and move the activator element away from the recess on relative movement of the two objects for the first time so as to draw fluid from the fluid reservoir towards the conduit on relative movement of the two objects for the first time.

16. An elapsed time indicator according to claim 14, comprising a substrate and a resilient membrane configured such that the membrane is elastically deformed when the activator element is inserted into the recess to form a seal between the membrane and the substrate to thereby seal the fluid in the fluid reservoir.

17. An elapsed time indicator according to claim 16, wherein the elapsed time indicator is configured such that movement of the activator element within the recess causes the membrane to disengage from the substrate to draw fluid from the fluid reservoir towards the conduit.

18. An elapsed time indicator according to claim 1, comprising a colour former.

19. An elapsed time indicator according to claim 1, wherein the fluid comprises an acid and the visual display arrangement comprises a colour former.

20. An elapsed time indicator according to claim 1, wherein the fluid comprises a colour former and the visual display arrangement comprises an acid.

21. An elapsed time indicator according to claim 18, wherein the colour former comprises pergascript red.

22. An elapsed time indicator according to claim 18, wherein the colour former comprises pergascript green.

23. An elapsed time indicator according to claim 19, wherein the acid comprises a naturally occurring acid.

24. An elapsed time indicator according to claim 23, wherein the acid comprises acetic acid or citric acid.

25. A container comprising the elapsed time indicator according to claim 1.

26. A container according to claim 25, comprising a lid and a body, wherein the elapsed time indicator is attached to both the lid and the body.

27. A method of manufacturing a container comprising:

providing a container; and attaching an elapsed time indicator to the container, wherein the elapsed time indicator comprises:

an activator arrangement comprising a fluid reservoir and a conduit configured to provide a predetermined flow rate of fluid along the conduit; and a visual display arrangement configured to change appearance on exposure to the fluid, wherein the conduit connects the fluid reservoir to the visual display arrangement and the activator arrangement is configured to release fluid from the fluid reservoir in response to opening of the container for the first time to permit the fluid to flow, and wherein the conduit has a cross-section that varies along the length of the conduit so as to at least partially establish the predetermined flow rate.

28. An elapsed time indicator comprising:

an activator arrangement comprising a fluid reservoir and a conduit configured to provide a predetermined flow rate of fluid along the conduit; and a visual display arrangement configured to change appearance on exposure to the fluid, wherein the conduit connects the fluid reservoir to the visual display arrangement and the activator arrangement is configured to release fluid from the fluid reservoir in response to an activation event to permit the fluid to flow, the activation event occurring upon relative movement of two objects for the first time, and the conduit having a cross-section that varies along the length of the conduit so as to at least partially establish the predetermined flow rate, wherein the conduit comprises a plurality of first portions each having a greater cross-section and a plurality of second portions each having a lesser cross-section, wherein adjacent first portions are connected by a respective second portion.

29. An elapsed time indicator according to claim 28, wherein the conduit has a uniform thickness and comprises a plurality of wider portions and a plurality of narrower portions, wherein adjacent wider portions are connected by a respective narrower portion.

30. An elapsed time indicator according to claim 29, wherein the narrower portions are linear and/or curved.

* * * * *